US010126670B2

(12) United States Patent
Tanaka

(10) Patent No.: US 10,126,670 B2
(45) Date of Patent: Nov. 13, 2018

(54) ELECTROSTATIC LATENT IMAGE DEVELOPING TONER

(71) Applicant: KYOCERA Document Solutions Inc., Osaka (JP)

(72) Inventor: Erika Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/876,236

(22) Filed: Jan. 22, 2018

(65) Prior Publication Data

US 2018/0224765 A1 Aug. 9, 2018

(30) Foreign Application Priority Data

Feb. 3, 2017 (JP) ..... 2017-018340

(51) Int. Cl.
*G03G 9/093* (2006.01)
*G03G 9/087* (2006.01)
*G03G 9/08* (2006.01)

(52) U.S. Cl.
CPC ..... *G03G 9/09364* (2013.01); *G03G 9/0819* (2013.01); *G03G 9/08711* (2013.01); (Continued)

(58) Field of Classification Search
CPC . G03G 9/093; G03G 9/09364; G03G 9/09371
See application file for complete search history.

(56) References Cited

U.S. PATENT DOCUMENTS 9,864,289 B2 * 1/2018 Nishitera ..... G03G 9/0819
10,007,201 B2 * 6/2018 Washino ..... G03G 9/09314
(Continued)

FOREIGN PATENT DOCUMENTS

JP 2004-212508 A 7/2004

*Primary Examiner* — Hoa V Le
(74) *Attorney, Agent, or Firm* — Studebaker & Brackett PC

(57) ABSTRACT

Toner particles of a toner each include a toner mother particle and an external additive. The toner mother particle includes a toner core containing a binder resin and a shell layer covering a surface of the toner core. The external additive contains a plurality of first external additive particles each containing a resin. The first external additive particles are present on a surface of the shell layer. The toner core and each of the first external additive particles are bonded together through a covalent bond in the shell layer. The covalent bond includes a first amide bond and a second amide bond. The shell layer contains a vinyl resin. The vinyl resin includes constitutional units (1-1), (1-2), and (1-3). The first amide bond is an amide bond included in the constitutional unit (1-1). The second amide bond is an amide bond included in the constitutional unit (1-2).

(1-1)

(1-2)

(Continued)

-continued (1-3)

7 Claims, 3 Drawing Sheets

(52) U.S. Cl.
CPC ..... *G03G 9/08755* (2013.01); *G03G 9/09328* (2013.01); *G03G 9/09371* (2013.01); *G03G 9/09392* (2013.01)

(56) References Cited

U.S. PATENT DOCUMENTS

2018/0024454 A1* 1/2018 Ojima ..... G03G 9/09321
430/108.1
2018/0143549 A1* 5/2018 Takemori ..... G03G 9/0819

* cited by examiner

ELECTROSTATIC LATENT IMAGE DEVELOPING TONER

INCORPORATION BY REFERENCE

The present application claims priority under 35 U.S.C. § 119 to Japanese Patent Application No. 2017-018340, filed on Feb. 3, 2017. The contents of this application are incorporated herein by reference in their entirety.

BACKGROUND

The present disclosure relates to an electrostatic latent image developing toner.

Toner particles included in a toner each include for example a toner mother particle and a silica powder externally added to a surface of the toner mother particle. In an example of a toner particle producing method, the silica powder is externally added to the surfaces of the toner mother particles through various stages. It is now examined to inhibit detachment of the silica powder from the surfaces of the toner mother particles in image formation through the above method.

SUMMARY

An electrostatic latent image developing toner according to the present disclosure has positive chargeability and includes a plurality of toner particles. The toner particles each include a toner mother particle and an external additive. The toner mother particle includes a toner core containing a binder resin and a shell layer covering a surface of the toner core. The external additive contains a plurality of first external additive particles each containing a resin. The first external additive particles are present on a surface of the shell layer. The toner core and each of the first external additive particles are bonded together through a covalent bond in the shell layer. The covalent bond includes a first amide bond and a second amide bond. The shell layer contains a vinyl resin. The vinyl resin includes a constitutional unit represented by the following formula (1-1), a constitutional unit represented by the following formula (1-2), and a constitutional unit represented by the following formula (1-3). The first amide bond is an amide bond included in the constitutional unit represented by the formula (1-1). The second amide bond is an amide bond included in the constitutional unit represented by the formula (1-2).

(1-1)

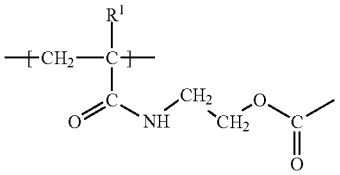

In the formula (1-1), $R^1$ represents a hydrogen atom or an optionally substituted alkyl group. An available bond of a carbon atom bonded to two oxygen atoms in the formula (1-1) is bonded to an atom constituting the binder resin.

(1-2)

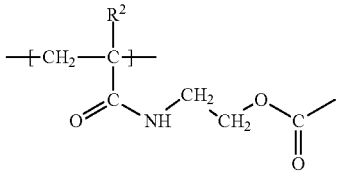

In formula (1-2), $R^2$ represents a hydrogen atom or an optionally substituted alkyl group. An available bond of a carbon atom bonded to two oxygen atoms in the formula (1-2) is bonded to an atom constituting the resin contained in each of the first external additive particles.

(1-3)

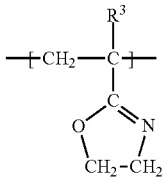

In the formula (1-3), $R^3$ represents a hydrogen atom or an optionally substituted alkyl group.

DETAILED DESCRIPTION

Figure 1:
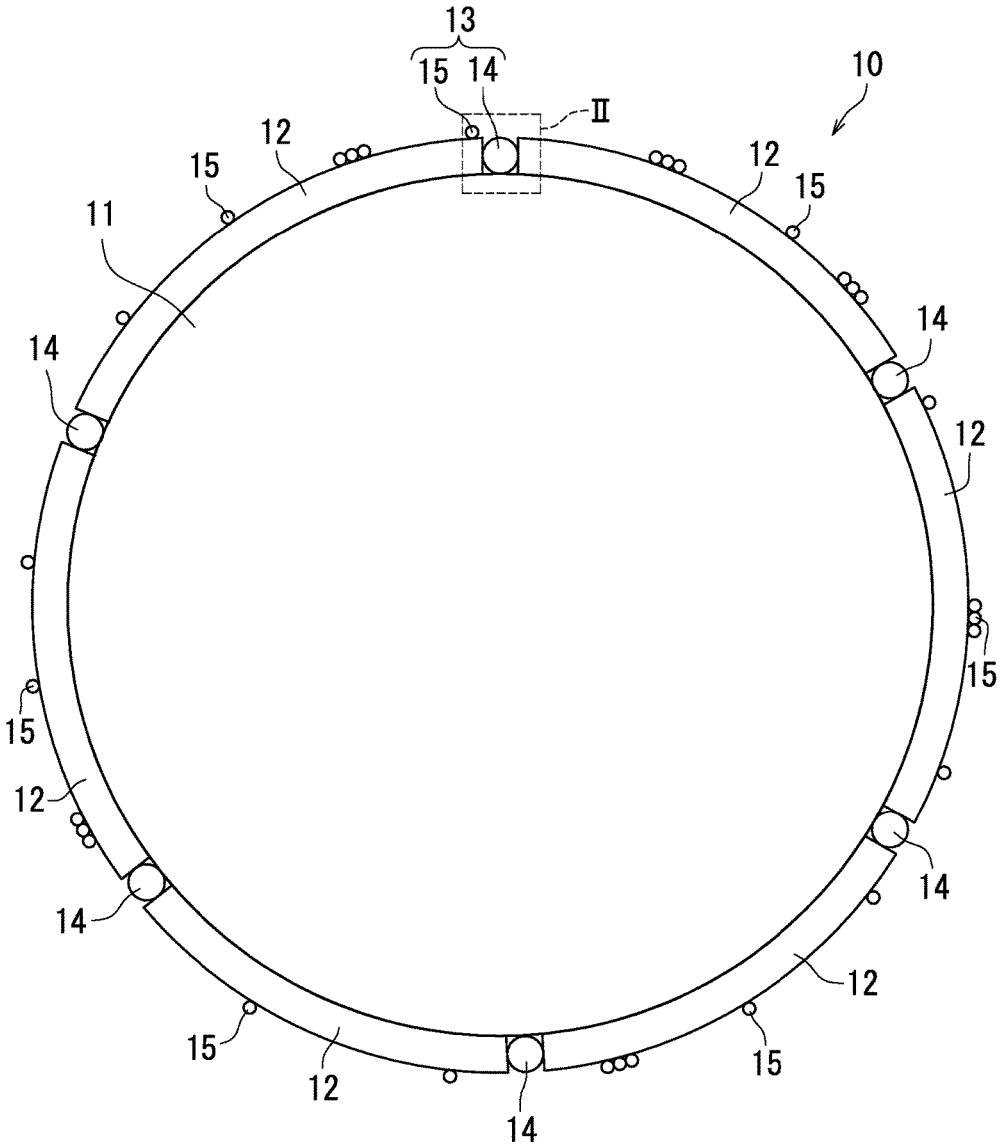
FIG. 1 is a cross-sectional view illustrating a configuration of a toner particle according to an embodiment of the present disclosure.

The following describes an embodiment of the present disclosure. Note that evaluation results (values indicating shape, physical properties, or the like) for toner cores, toner mother particles, toner particles, or external additive particles were number average values measured with respect to an appropriate number of particles unless otherwise stated.

Also, unless otherwise stated, the number average particle diameter of a powder was a number average value of equivalent circle diameters of primary particles of the powder (diameters of circles having the same areas as projected areas of the particles) measured using a microscope. Values for volume median diameter ($D_{50}$) of a powder were measured based on the Coulter principle (electrical sensing zone technique) using "Coulter Counter Multisizer 3" produced by Beckman Coulter, Inc. unless otherwise stated.

Acid values and hydroxyl values were measured in accordance with "Japanese Industrial Standard (JIS) K0070-1992" unless otherwise stated. Values for number average molecular weight (Mn) and mass average molecular weight (Mw) were values measured by gel permeation chromatography unless otherwise stated. Values for glass transition point (Tg) and melting point (Mp) were values measured using a differential scanning calorimeter ("DSC-6220" produced by Seiko Instruments Inc.) unless otherwise stated. Values for softening point (Tm) were values measured using a capillary rheometer ("CFT-500D" produced by Shimadzu Corporation) unless otherwise stated.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a constitutional unit (repeating unit) of the polymer originates from the chemical compound or a derivative thereof. In the present description, the term "(meth)acryl" is used as a generic term for both acryl and methacryl.

Chargeability refers to chargeability in triboelectric charging unless otherwise stated. The phrase "having high positive chargeability" in the following description means high positive chargeability in triboelectric charging. Positive chargeability or negative chargeability in triboelectric charging can be determined using a known triboelectric series.

An electrostatic latent image developing toner according to the present embodiment (also referred to below simply as "toner") may constitute a one-component developer or a two-component developer in combination with a carrier for electrostatic latent image development (also referred to below simply as a "carrier"). The toner is an aggregate of toner particles (powder).

The toner according to the present embodiment can be used for image formation for example using an electrophotographic device (image forming apparatus). The following method can be employed for example as a method for forming an image using the toner according to the present embodiment. First, a charger uniformly charges a photosensitive layer of a photosensitive drum. Next, an exposure device forms an electrostatic latent image on the photosensitive layer based on image data. A developing device then develops the electrostatic latent image using toner carried on a magnetic roller. Specifically, a development sleeve of the development roller disposed in the vicinity of the photosensitive drum attracts toner by magnetic force of a magnet roll embedded in the development roller. Through toner attraction, the toner is carried on the surface of the development roller. The toner on the development sleeve is supplied to the photosensitive layer by rotation of the development sleeve. Thus, the toner is attached to the electrostatic latent image to form a toner image on the surface of the photosensitive layer. Subsequently, a transfer device transfers the toner image to a recording medium (specifically, printing paper). Thereafter, a fixing device fixes toner particles included in the toner image to the recording medium.

[Configuration of Electrostatic Latent Image Developing Toner According to Present Embodiment]

The toner according to the present embodiment is positively chargeable and includes a plurality of toner particles. The toner particles each include a toner mother particle and an external additive. The toner mother particle includes a toner core and a shell layer. The toner core contains a binder resin. The shell layer covers a surface of the toner core. The external additive contains a plurality of first external additive particles each containing a resin. The first external additive particles are present on a surface of the shell layer. The toner core and each of the first external additive particles are bonded together through a covalent bond in the shell layer in each of the toner particles.

As described above, the toner core and each of the first external additive particles are bonded together through the covalent bond in the shell layer. In the above configuration, detachment of the first external additive particles from the surfaces of the shell layers can be inhibited in image formation. The first external additive particles each contain the resin. In the above configuration, when detachment of the first external additive particles from the surfaces of the shell layers in image formation can be inhibited, a toner excellent in heat resistance, thermal-stress resistance, and charge stability can be provided.

Furthermore, detachment of the first external additive particles from the surfaces of the shell layers in image formation can be inhibited, which can result in that attachment of the first external additive particles to surfaces of other members can be inhibited. This can inhibit attachment of the toner mother particles (particularly, a resin component of the toner mother particles) to the surfaces of another member caused due to attachment of the first external additive particles thereto can be inhibited. As a result, contamination of the surfaces of the other members by the first external additive parties or the toner mother particles can be inhibited.

For example, when contamination of a surface of the development sleeve can be inhibited, occurrence of irregularity in amount of toner particles attracted by magnetic force can be prevented on the surface of the development sleeve. As a result, occurrence of irregularity in amount of toner conveyed while being held on the surface of the development sleeve (conveyed toner amount) can be prevented. Thus, occurrence of development irregularity can be prevented. A toner excellent in developability can be provided accordingly.

When contamination of the photosensitive layer of the photosensitive drum can be prevented, occurrence of transfer irregularity to a recording medium can be prevented. Through the above, occurrence of transfer irregularity can be prevented. In consequence, a toner excellent in developability can be provided also for the reason as above.

In a configuration in which the toner according to the present embodiment constitutes a two-component developer, contamination of surfaces of carrier particles can be prevented. Through the above, lowering in charge amount of toner can be inhibited. In consequence, a toner excellent in developability can be provided also for the reason as above.

As described above, the toner according to the present embodiment is excellent in developability in addition to heat resistance, thermal-stress resistance, and charge stability. Also for the reason as above, stable image formation for a long term can be achieved.

Description of the toner particles will be further continued. The covalent bond in the shell layer that bonds the toner core and each of the first external additive particles together (also referred to below as "specific covalent bond") includes a first amide bond and a second amide bond. The shell layer contains a vinyl resin.

The vinyl resin herein refers to a homopolymer of a vinyl compound or a copolymer of vinyl compounds. Each of the vinyl compounds has at least one functional group among a vinyl group ($CH_2{=}CH{-}$), a vinylidene group ($CH_2{=}C<$), and a vinylene group ($-CH{=}CH-$) in a molecule thereof. When an addition polymerization reaction occurs through cleavage of a carbon double bond ($C{=}C$) included in the functional group such as the vinyl group, the vinyl compounds become a macromolecule (vinyl resin).

The vinyl resin in the present embodiment includes a constitutional unit represented by the following formula (1-1) (also referred to below as a "constitutional unit (1-1)"), a constitutional unit represented by the following formula (1-2) (also referred to below as a "constitutional unit (1-2)"), and a constitutional unit represented by the following formula (1-3) (also referred to below as a "constitutional unit (1-3)"). Note that the first amide bond is an amide bond [C(=O)—NH] included in the constitutional unit (1-1). The second amide bond is an amide bond [C(=O)—NH] included in the constitutional unit (1-2). The vinyl resin including the constitutional units (1-1), (1-2), and (1-3) will be referred to below as a "specific vinyl resin".

(1-1)

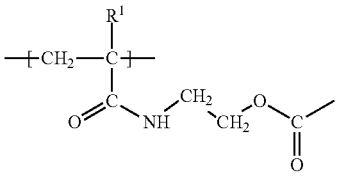

In formula (1-1), $R^1$ represents a hydrogen atom or an optionally substituted alkyl group. The alkyl group includes a straight chain alkyl group, a branched chain alkyl group, and a cyclic alkyl group. A phenyl group is an example of a substituent that the alkyl group has. Preferably, $R^1$ represents a hydrogen atom, a methyl group, an ethyl group, or an isopropyl group. An available bond of a carbon atom bonded to two oxygen atoms in the formula (1-1) is bonded to an atom constituting the binder resin. In formula (1-1), the available bond of the carbon atom bonded to the two oxygen atoms is a bond not bonded to the two oxygen atoms among four bonds that the carbon atom bonded to the two oxygen atoms has in formula (1-1). The atom constituting the binder resin is for example an atom to which a later-described first carboxyl group is bonded.

(1-2)

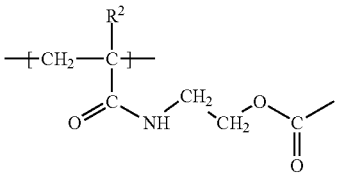

In formula (1-2), $R^2$ represents a hydrogen atom or an optionally substituted alkyl group. The alkyl group includes a straight chain alkyl group, a branched chain alkyl group, and a cyclic alkyl group. A phenyl group is an example of a substituent that the alkyl group has. Preferably, $R^2$ represents a hydrogen atom, a methyl group, an ethyl group, or an isopropyl group. An available bond of a carbon atom bonded to two oxygen atoms in the formula (1-2) is bonded to an atom constituting the resin that the first external additive particles each contain. In formula (1-2), the available bond of the carbon atom bonded to the two oxygen atoms is a bond not bonded to the two oxygen atoms among four bonds that the carbon atom bonded to the two oxygen atoms has in formula (1-2). The atom constituting the resin that the first external additive particles each contain is for example an atom to which a later-described second carboxyl group is bonded.

(1-3)

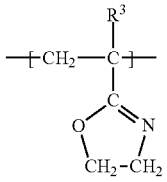

In formula (1-3), $R^3$ represents a hydrogen atom or an optionally substituted alkyl group. The alkyl group includes a straight chain alkyl group, a branched chain alkyl group, and a cyclic alkyl group. A phenyl group is an example of a substituent that the alkyl group has. Preferably, $R^3$ represents a hydrogen atom, a methyl group, an ethyl group, or an isopropyl group.

The shell layers are preferably formed by the following method. Specifically, the toner cores, a dispersion of the first external additive particles, and a solution of a vinyl resin for formation are prepared first. The prepared toner cores and the prepared first external additive particles each have a carboxyl group on a surface thereof. The vinyl resin for formation includes the constitutional unit (1-3). As such, the vinyl resin for formation has a plural number of oxazoline groups (closed rings). The vinyl resin for formation can be obtained by polymerization of a compound represented by a later-described formula (1-4). The constitutional unit (1-3) is derived from a compound represented by the later-described formula (1-4).

Next, the toner cores, the dispersion of the first external additive particles, and the solution of the vinyl resin for formation are mixed together. The resulting dispersion is increased in temperature up to a specific temperature while being stirred, and then kept at the specific temperature for a specific time period.

The specific temperature is no less than a temperature at which amide bonds are formed by respective reactions between the oxazoline group included in the constitutional unit (1-3) and the first carboxyl group (a carboxyl group that is present on the surfaces of the toner cores and preferably a carboxyl group that is present on the surfaces of the toner cores and that the binder resin has) and between the oxazoline group included in the constitutional unit (1-3) and the second carboxyl group (a carboxyl group that is present on the surfaces of the first external additive particles and preferably a carboxyl group that is present on the surfaces of the first external additive particles and that the resin contained in each of the first external additive particles has). It is accordingly thought that the following reaction proceeds during the time when the temperature of the dispersion is kept at the specific temperature. Specifically, some of the oxazoline groups included in the constitutional unit (1-3) react with the first carboxyl group to be ring-opened. Through ring opening, the first amide bond is formed. As a result, the constitutional unit (1-1) is formed. Some of the remaining oxazoline groups react with the second carboxyl group to be ring-opened. Through ring opening, the second amide bond is formed. As a result, the constitutional unit (1-2) is formed. Oxazoline groups among the oxazoline groups that react with neither the first carboxyl group nor the second carboxyl group are not ring-opened (constitutional unit (1-3)). Through the above, the shell layers are formed. Note that it has been known that an oxazoline group is highly positively chargeable. The specific vinyl resin, which includes the constitutional unit (1-3), has a plural number of oxazoline groups (closed rings). A positively chargeable toner excellent in charging characteristic can be accordingly provided.

A technique of thermally fusing the first external additive particles to the surfaces of the shell layers has been known. By contrast, the toner core and each of the first external additive particles are bonded together through the specific covalent bond in the present embodiment. In the above configuration, the first external additive particles are hardly detached from the surfaces of the shell layers when compared with a configuration in which the first external additive particles are thermally fused to the surfaces of the shell layers. Therefore, a toner excellent in heat resistance, thermal-stress resistance, charge stability, and developability can be easily provided.

The following method can be expected for example as a method for confirming the presence of the specific covalent bond. Specifically, a specific amount of the toner particles (sample) are dissolved in a solvent. The resulting solution is put into a test tube for nuclear magnetic resonance (NMR) measurement, and a $^{1}$H-NMR spectrum is measured using a NMR apparatus. Here, it has been known that a triplet signal derived from secondary amide appears around a chemical shift δ of 6.5 in a $^{1}$H-NMR spectrum. As such, when a triplet signal is observed around a chemical shift δ of 6.5 in the measured $^{1}$H-NMR spectrum, it can be inferred that the specific covalent bond is present in the toner particles. It is accordingly inferred that the toner core and each of the first external additive particles are bonded together through the specific covalent bond. The following lists conditions as examples of conditions for $^{1}$H-NMR spectrum measurement.

<Examples of Conditions for $^{1}$H-NMR Spectrum Measurement>

NMR apparatus: Fourier transform nuclear magnetic resonance apparatus (FT-NMR, "JNM-AL400" produced by JEOL Ltd.).

Test tube for NMR measurement: 5-mm test tube.

Solvent: deuterated chloroform (1 mL).

Sample temperature: 20° C.

Sample amount: 20 mg.

Cumulative number of times: 128 times.

Internal standard substance for chemical shift: tetramethylsilane (TMS).

[Preferable Configuration of Electrostatic Latent Image Developing Toner According to Present Embodiment]

The following describes a preferable configuration of the toner according to the present embodiment.

<Detachment Ratio of First External Additive Particles>

A detachment ratio of the first external additive particles when the toner according to the present embodiment is irradiated with a ultrasonic having a high frequency output of 100 W and an oscillation frequency of 50 kHz for ten minutes (also referred to below simply as a "detachment ratio of the first external additive particles") is preferably at least 0.1% and less than 5.0%. The detachment ratio of the first external additive particles is preferably measured by a method described later in Examples or a method in accordance therewith.

In a configuration in which the toner core and each of the first external additive particles are not bonded together through the specific covalent bond, the detachment ratio of the first external additive particles is at least 5.0% (see later-described Comparative Examples 1-3). It is difficult to attain a detachment ratio of the first external additive particles of less than 5.0% even in a configuration in which the first external additive particles are thermally fused to the surfaces of the shell layers. By contrast, the toner according to the present embodiment, in which the toner cores and each of the first external additive particles are bonded together through the specific covalent bond, can attain a detachment ratio of the first external additive particles of less than 5.0%.

<Toner Core>

The toner core contains the binder resin as described above. Preferably, the binder resin has an acid value of at least 1.0 mgKOH/g and no greater than 10.0 mgKOH/g. When the binder resin has an acid value of at least 1.0 mgKOH/g, the reaction between the first carboxyl group and the oxazoline group tends to readily proceed, with a result that the first amide bond tends to be readily formed. When the binder resin has an acid value of no greater than 10.0 mgKOH/g, a toner excellent in charge stability can be provided independent of an environment in image formation. Reduction in charge amount of the toner can be inhibited for example even in image formation in a high-humidity environment. More preferably, the binder resin has an acid value of at least 3.0 mgKOH/g and no greater than 7.0 mgKOH/g. The acid value of the binder resin is preferably measured by a method described later in Examples or a method in accordance therewith.

Further preferably, the binder resin contains a resin having an acid value of at least 1.0 mgKOH/g and no greater than 10.0 mgKOH/g. In the above configuration, the binder resin tends to have an acid value of at least 1.0 mgKOH/g and no greater than 10.0 mgKOH/g. More specifically, the binder resin preferably contains at least one of a polyester resin and a styrene-acrylic acid-based resin.

<Shell Layer>

Preferably, the shell layer further contains a resin different from the specific vinyl resin (also referred to below as a "different resin A"). The different resin A preferably contains a positively chargeable resin and a hydrophobic resin. The "positively chargeable resin" herein refers to a resin having positive chargeability higher than that of the binder resin. In a configuration in which two or more types of binder resins are present, the positively chargeable resin is more excellent in positive chargeability than any of the binder resins. The "hydrophobic resin" refers to a resin having hydrophobicity higher than that of the positively chargeable resin. In a configuration in which two types of positively chargeable resins are present, the hydrophobic resin is more excellent in hydrophobicity than any of the positively chargeable resins. When the shell layer further contains the different resin A, a positively chargeable toner excellent in chargeability can be provided. The shell layer that further contains the different resin A preferably has the following configuration.

Preferably, the specific vinyl resin is present at a part of the shell layer that is located between the toner core and each of the first external additive particles. The different resin A preferably covers a part of a surface region of the toner core that is exposed from among the specific vinyl resin. More preferably, the different resin A surrounds each of the first external additive particles in a surface region of the shell layer. Further preferably, the different resin A does not cover the respective surfaces of the first external additive particles in the surface region of the shell layer. When the different resin A does not cover the surfaces of the first external additive particles in the surface region of the shell layer, a toner further excellent in heat resistance, thermal-stress resistance, and charge stability can be provided. Hereinafter, parts of the shell layer that are located between the toner core and the first external additive particles may be referred to as "intervening portions". Also, parts of the shell layer that cover parts of the surface region of the toner core that are exposed from among the intervening portions may be referred to as "peripheral portions".

Preferably, the intervening portions each have a thickness of at least 5 nm and no greater than 10 nm. When the intervening portions have a thickness of at least 5 nm, a sufficient amount of the specific vinyl resin in the intervening portion tends to be ensured. Accordingly, the specific covalent bond tends to be readily formed. When the intervening portions have a thickness of no greater than 10 nm, increase in diameter of the toner particles can be inhibited. The thickness of the intervening portions refers to a dimension of the respective intervening portions in a radial direction of a toner particle.

The thickness of the intervening portions can be measured by the following method. First, a sectional TEM photograph of a toner particle is captured using a transmission electron microscope (TEM, "H-7100FA" produced by Hitachi High-Technologies Corporation, for example). The captured sectional TEM photograph of the toner particle is analyzed using image analysis software (e.g., "WinROOF" produced by Mitani Corporation). Specifically, two straight lines perpendicularly intersecting each other at a substantial center of the section of the toner particle are drawn. A length from the surface of an intervening portion to a boundary between a toner core and the intervening portion (corresponding to the surface of the toner core) is measured on each of the two straight lines. The average value of four lengths measured as above is determined as the thickness of the intervening portions of the single toner particle. The respective thicknesses of the intervening portions of a plurality of toner particles are measured, and an average value of the thicknesses of the intervening portions of the respective toner particles (measurement target) is calculated. The average value of the thicknesses of the intervening portions obtained as above is referred to as an "intervening portion thickness".

In a situation in which the boundary between the toner core and the intervening portion is vague in the sectional TEM photograph of the toner particle, the sectional TEM photograph of the toner particle is analyzed using an electron energy loss spectroscopy (EELS) detector (e.g., "GIF TRIDIEM (registered Japanese trademark)" produced by Gatan, Inc.) and image analysis software (e.g., "WinROOF" produced by Mitani Corporation).

Preferably, the peripheral portions have a thickness of at least 3 nm and no greater than 50 nm. When the peripheral portions have a thickness of at least 3 nm, heat resistance of the toner tends to improve. When the peripheral portion has a thickness of no greater than 50 nm, low-temperature fixability of the toner tends to improve. The thickness of the peripheral portions refers to a dimension of the peripheral portions in the radial direction of a toner particle. The thickness of the peripheral portions can be measured by the above method for measuring the intervening portion thickness.

Preferably, the shell layer has extension portions. The "extension portions" each extend outward in the radial direction of the toner particle from the intervening portion and cover a part of the surface of a corresponding one of the first external additive particles. When the second carboxyl group present outward of the first external additive particle in the radial direction of the toner particle reacts with the oxazoline group, the shell layer tends to have the extension portions. For the reason as above, the extension portions are constituted by the specific vinyl resin in many cases.

<External Additive>

(First External Additive Particles>

The first external additive particles preferably have a number average primary particle diameter of at least 10 nm and no greater than 50 nm. The first external additive particles having a number average primary particle diameter of at least 10 nm can be easily produced. When the first external additive particles have a number average primary particle diameter of no greater than 50 nm, space to which external additive particles different from the first external additive particles (e.g., later-described second external additive particles) are attached can be easily reserved in the surface region of the shell layer.

The first external additive particles each contain a resin. Hereinafter, the resin contained in each of the first external additive particles is referred to as a "resin B". Preferably, the resin B has an acid value of at least 1.0 mgKOH/g and no greater than 50.0 mgKOH/g. When the resin B has an acid value of at least 1.0 mgKOH/g, the reaction between the second carboxyl group and the oxazoline group tends to readily proceed, with a result that the second amide bond tends to be readily formed. When the resin B has an acid value of no greater than 50.0 mgKOH/g, a toner excellent in charge stability can be provided independent of an environment in image formation. Reduction in charge amount of the toner can be inhibited for example even in image formation in a high-humidity environment. More preferably, the resin B has an acid value of at least 5.0 mgKOH/g and no greater than 40.0 mgKOH/g. The acid value of the resin B is preferably measured by a method described later in Examples or a method in accordance therewith.

Further preferably, the resin B contains a resin having an acid value of at least 1.0 mgKOH/g and no greater than 50.0 mgKOH/g. In the above configuration, the resin B tends to have an acid value of at least 1.0 mgKOH/g and no greater than 50.0 mgKOH/g. More specifically, the resin B contains at least one of a polyester resin and a styrene-acrylic acid-based resin and further preferably contains a styrene-acrylic acid-based resin.

(Second External Additive Particles)

Preferably, the external additive further contains a plurality of second external additive particles. The second external additive particles preferably contain no resin and preferably are silica particles or particles of a metal oxide. Preferable examples of the metal oxide include alumina, titanium oxide, magnesium oxide, zinc oxide, strontium titanate, and barium titanate. The external additive may contain one type of second external additive particles or two or more types of second external additive particles. The content of the second external additive particles in the toner particles is preferably at least 0.5 parts by mass and no greater than 10 parts by mass relative to 100 parts by mass of the toner cores. The second external additive particles preferably have a particle diameter of at least 0.01 μm and no greater than 1.0 μm.

The second external additive particles are preferably located at parts of the surface region of the shell layer that are exposed from among the first external additive particles. In the above configuration, fluidity of the toner particles can improve while heat resistance, thermal-stress resistance, charge stability, and developability of the toner can be maintained. Specifically, the second external additive particles are preferably located on parts of the surface of the shell layer that contain the positively chargeable resin and the hydrophobic resin. The preferable configuration of the toner according to the present embodiment will be described below in detail with reference to the accompanying drawings.

[Configuration of Electrostatic Latent Image Developing Toner According to Specific Example]

Figure 2:
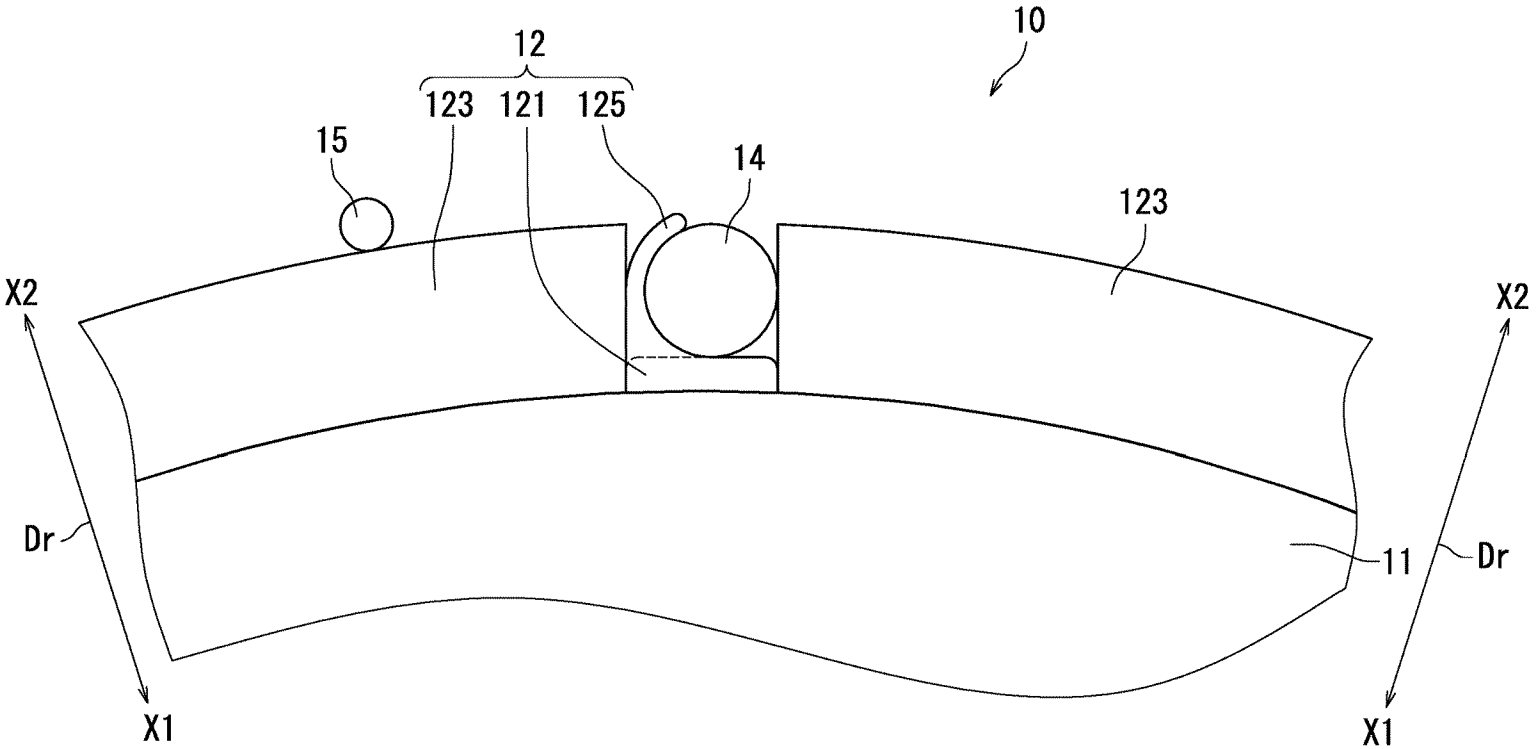
FIG. 2 is a diagram schematically illustrating a region II in FIG. 1.

FIG. 1 is a cross-sectional view illustrating a configuration of a toner particle included in a toner according to a specific example. FIG. 2 is a diagram schematically illustrating a region II in FIG. 1. Note that in FIG. 2: "Dr" represents a radial direction of a toner particle 10; "X1" represents a radially inward direction of the toner particle 10; and "X2" represents a radially outward direction of the toner particle 10.

The toner particle 10 illustrated in FIG. 1 includes a toner core 11, a shell layer 12, and an external additive 13. The toner core 11 contains the binder resin. The shell layer 12 covers a surface of the toner core 11 and contains the specific vinyl resin and the different resin A. The external additive 13 contains a plurality of first external additive particles 14 and a plurality of second external additive particles 15. The first external additive particles 14 contain the resin B and are present on a surface of the shell layer 12. The toner core 11 and each of the first external additive particles 14 are bonded together through the specific covalent bond. The specific covalent bond includes the first and second amide bonds.

The shell layer 12 includes intervening portions 121, peripheral portions 123, and extension portions 125, as illustrated in FIG. 2. The intervening portions 121 are each present between the toner core 11 and one of the first external additive particles 14. The peripheral portions 123 each cover a part of a surface region of the toner core 11 that is exposed from among the intervening portions 121. The second external additive particles 15 are present on surfaces of the peripheral portions 123. The extension portions 125 extend from the respective intervening portions 121 in the radially outward direction X2 of the toner particle 10 and cover parts of surfaces of the respective first external additive particles 14. The intervening portions 121 and the extension portions 125 are constituted by the specific vinyl resin. The peripheral portions 123 contain the positively chargeable resin and the hydrophobic resin.

Note that the intervening portions 121, the peripheral portions 123, and the extension portions 125 are not limited to having the respective cross-sectional shapes illustrated in FIG. 2. Gaps may be or not be present between the first external additive particles 14 and any of the intervening portions 121, the peripheral portions 123, and the extension portions 125. The respective contours of the gaps in cross section is not limited to that illustrated in FIG. 2. The configuration of the toner particle included in the toner according to the specific example has been described so far with reference to FIGS. 1 and 2. The following describes a preferable production method of the toner according to the present embodiment.

[Preferable Production Method of Electrostatic Latent Image Developing Toner According to Present Embodiment]

A production method of the toner according to the present embodiment preferably includes production of composite particles, and more preferably, further includes external addition. The composite particles herein each include a toner mother particle and the first external additive particles but do not include external additive particles different from the first external additive particles (e.g., the second external additive particles). The toner core and each of the first external additive particles are bonded together through the specific covalent bond in each of the composite particles. Note that in a configuration in which the toner particle does not include external additive particles different from the first external additive particles, the composite particles and the toner particles are equivalent. The toner particles are thought to have substantially the same configuration when produced at the same time.

<Production of Composite Particles>

Production of composite particles preferably includes production of toner cores, preparation of a dispersion of the first external additive particles, preparation of a liquid for shell layer formation, and formation of shell layers.

(Production of Toner Cores)

In production of toner cores, toner cores having the first carboxyl group are produced. When toner cores are produced by a known pulverization or aggregation method, the toner cores can be easily produced.

A binder resin used in production of the toner cores by either method preferably has an acid value of at least 1 mgKOH/g and no greater than 10 mgKOH/g. When the binder resin has an acid value of at least 1 mgKOH/g and no greater than 10 mgKOH/g, toner cores having the first carboxyl group can be easily produced.

(Preparation of Dispersion of First External Additive Particles)

In preparation of a dispersion of the first external additive particles, a dispersion of the first external additive particles having the second carboxyl group is prepared. It is preferable to prepare the dispersion of the first external additive particles by the following method. Specifically, a monomer capable of constituting the resin B is preferably polymerized in a dispersion medium. More specifically, a monomer capable of constituting the resin B is polymerized in the presence of a polymerization initiator. One type of monomer may be homopolymerized. Alternatively, two or more types of monomers may be copolymerized. Through the above, the dispersion of the first external additive particles is obtained. Note that the above dispersion medium preferably contains for example water (specifically, ion-exchanged water).

(Preparation of Liquid for Shell Layer Formation)

In preparation of a liquid for shell layer formation, a solution of the vinyl resin for formation is preferably prepared. For example, "EPOCROS (registered Japanese trademark) WS-300" produced by NIPPON SHOKUBAI CO., LTD. is usable as the solution of the vinyl resin for formation. EPOCROS WS-300 contains a copolymer of 2-vinyl-2-oxazoline and methyl methacrylate (water-soluble cross-linking agent). The monomers constituting the copolymer have a mass ratio ((2-vinyl-2-oxazoline):(methyl methacrylate)) of 9:1. The 2-vinyl-2-oxazoline herein corresponds to a vinyl compound represented by the following formula (1-4) in which $R^4$ represents a hydrogen atom.

(1-4)

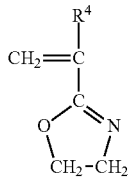

In formula (1-4), $R^4$ represents a hydrogen atom or an optionally substituted alkyl group. The alkyl group includes a straight chain alkyl group, a branched chain alkyl group, and a cyclic alkyl group. A phenyl group is an example of a substituent that the alkyl group has. Preferably, $R^4$ represents a hydrogen atom, a methyl group, an ethyl group, or an isopropyl group.

More preferably, a liquid containing the vinyl resin for formation and particles each containing the different resin A is prepared. Further preferably, a liquid containing the vinyl resin for formation, particles each containing a positively chargeable resin (also referred to below simply as "resin particles P1"), and particles each containing a hydrophobic resin (also referred to below simply as "resin particles P2") is prepared. More specifically, a solution of the vinyl resin for formation, a dispersion of the resin particles P1, and a dispersion of the resin particles P2 are prepared and mixed together to prepare the liquid for shell layer formation.

In preparation of the dispersion of the resin particles P1, a positively chargeable monomer is preferably polymerized in a first dispersion medium. More specifically, the positively chargeable monomer is polymerized in the presence of a polymerization initiator. One type of positively chargeable monomer may be homopolymerized. Alternatively, two or more types of positively chargeable monomers may be copolymerized. Through the above, the dispersion of the resin particles P1 is obtained. Note that the first dispersion medium preferably contains for example water (specifically, ion-exchanged water).

In preparation of the dispersion of the resin particles P2, a hydrophobic monomer is preferably polymerized in a second dispersion medium. More specifically, the hydrophobic monomer is polymerized in the presence of a polymerization initiator. One type of hydrophobic monomer may be homopolymerized. Alternatively, two or more types of hydrophobic monomers may be copolymerized. Through the above, the dispersion of the resin particles P2 is obtained. Note that the second dispersion medium preferably contains for example water (specifically, ion-exchanged water).

(Formation of Shell Layers)

In formation of shell layers, shell layers that cover the respective surfaces of the toner cores are formed. Specifically, the toner cores, the dispersion of the first external additive particles, and the liquid for shell layer formation are mixed together at a specific temperature. The specific temperature herein refers to a temperature not less than a temperature at which an amide bond is formed through the reactions between the oxazoline group and the first carboxyl group and between the oxazoline group and the second carboxyl group. Through the above reaction, the shell layers are formed, with a result that a dispersion of the composite particles is obtained. When solid-liquid separation, washing, and drying are performed on the dispersion obtained as above, a plurality of composite particles are obtained.

Specifically, the toner cores, the dispersion of the first external additive particles, and the liquid for shell layer formation are mixed together first to obtain a dispersion (also referred to below as a "dispersion E"). A material forming the shell layers (shell material) is attached to the surfaces of the toner cores in the dispersion E. In order that the shell material is uniformly attached to the surfaces of the toner cores, preferably, the toner cores are highly dispersed in the dispersion E. The dispersion E may contain a surfactant or be stirred using a powerful stirring apparatus (e.g., "Hivis Disper Mix" produced by PRIMIX Corporation) in order to highly disperse the toner cores in the dispersion E.

Subsequently, the temperature of the dispersion E is increased up to the specific temperature at a specific heating rate while the dispersion E is stirred. Thereafter, the dispersion E is kept at the specific temperature for a specific time period while being stirred. The specific temperature is no less than a temperature at which the amide bonds are formed through the reactions between the oxazoline group and the first carboxyl group and between the oxazoline group and the second carboxyl group, as described above. It is accordingly thought that the reactions between the oxazoline group and the first carboxyl group and between the oxazoline group and the second carboxyl group proceed during the time when the dispersion E is kept at the specific temperature.

The specific temperature is preferably a temperature of at least 50° C. and no greater than 100° C. When the specific temperature is at least 50° C., the reactions between the oxazoline group and the first carboxyl group and between the oxazoline group and the second carboxyl group tend to readily proceed. When the specific temperature exceeds 100° C., dispersibility of the toner cores in the dispersion E may reduce to cause agglomeration of the toner cores in the dispersion E. When the toner cores agglomerate in the dispersion E, the agglomerating toner cores may melt and fuse. When the toner cores melt and fuse in the dispersion E, it is difficult to uniformly attach the shell material to the surfaces of the toner cores.

Preferably, the specific heating rate is for example at least 0.1° C./minute and no greater than 3° C./minute. Preferably, the specific time period is for example at least 30 minutes and no greater than four hours. The dispersion E is preferably stirred at a rotational speed of at least 50 rpm and no greater than 500 rpm. Through the settings as above, the reactions between the oxazoline group and the first carboxyl group and between the oxazoline group and the second carboxyl group tend to readily proceed.

Figure 3:
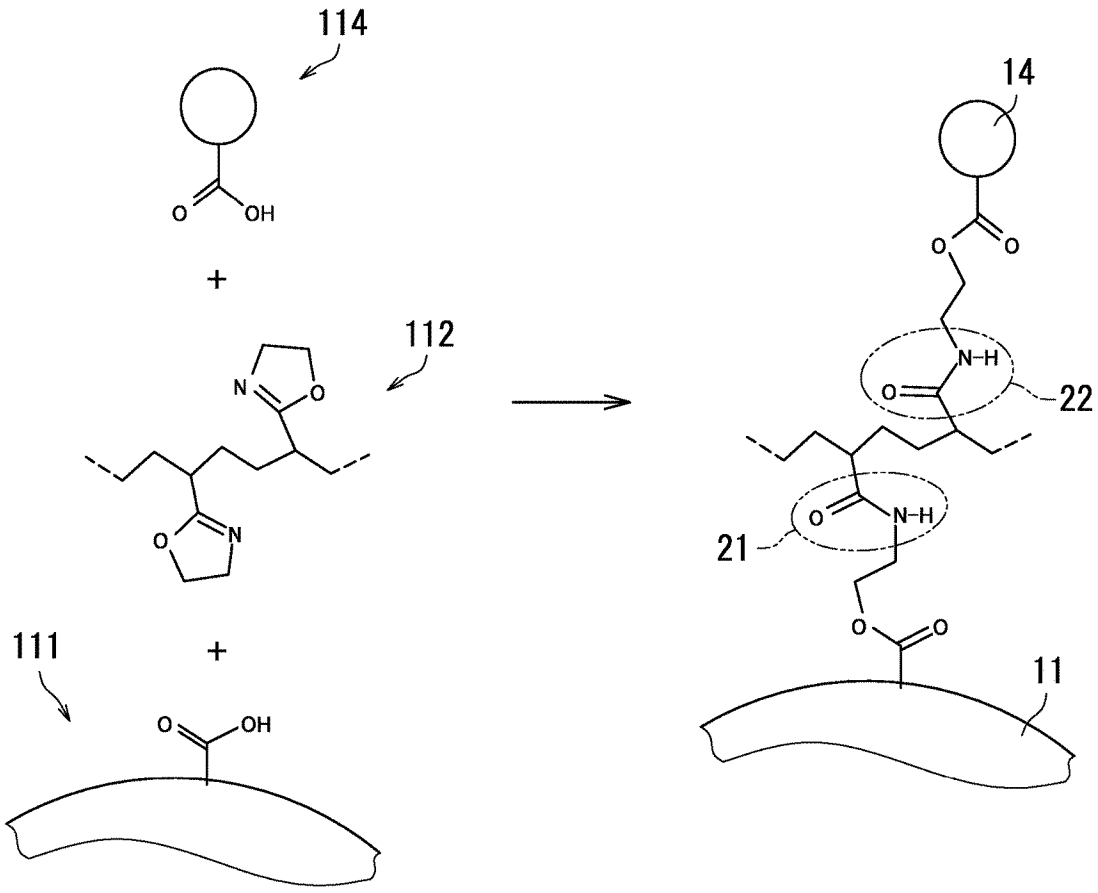
FIG. 3 is a diagram schematically illustrating a process of a toner particle producing method according to an embodiment of the present disclosure.

Shell layer formation will be described in detail below with reference to a drawing. FIG. 3 is a diagram schematically illustrating a process of a composite particle production method and specifically a diagram schematically illustrating shell layer formation. More specifically, FIG. 3 illustrates a reaction process by which one first carboxyl group and one second carboxyl group are bonded together through the specific covalent bond. Note that FIG. 3 illustrates a chemical structural formula by omitting some atoms (specifically, by omitting carbon atoms, and hydrogen atoms which bond to carbon atoms).

First, toner cores 111, a dispersion of first external additive particles 114, and the liquid for shell layer formation are mixed together to obtain the dispersion E. The toner cores 111 each have a carboxyl group (first carboxyl group) on a surface thereof. The liquid for shell layer formation contains a vinyl resin for formation 112. The vinyl resin for formation 112 includes the constitutional unit (1-3). The first external additive particles 114 each have a carboxyl group (second carboxyl group) on a surface thereof.

Next, the temperature of the dispersion E is increased up to the specific temperature (e.g., 70° C.) at the specific heating rate (e.g., a heating rate of 1° C./minute) while the dispersion E is stirred. Thereafter, the dispersion E is kept at the specific temperature over the specific time period (e.g., two hours) while being stirred. The reactions between the oxazoline group and the first carboxyl group and between the oxazoline group and the second carboxyl group proceed during the time when the dispersion E is kept at the specific temperature. More specifically, the reaction between the first carboxyl group and the oxazoline group proceeds to form a first amide bond 21. The reaction between the second carboxyl group and the oxazoline group also proceeds to form a second amide bond 22. In a manner as above, the toner core 11 and each of the first external additive particles 14 are bonded together through the specific covalent bond to form the shell layer 12 (see FIG. 1). Shell layer formation has been described so far with reference to FIG. 3. The following returns to the preferable method for producing the toner according to the present embodiment.

<External Addition>

The composite particles and external additive particles different from the first external additive particles (e.g., the second external additive particles) are mixed together using a mixer (e.g., an FM mixer produced by Nippon Coke & Engineering Co., Ltd.). Mixing as above results in production of a toner including a plurality of toner particles.

[Examples of Materials Constituting Toner and Properties Thereof]

The toner includes the plurality of toner particles. The toner particles each include the toner core, the shell layer, and the first external additive particles. The following describes the toner cores, the shell layers, and the first external additive particles in stated order.

<Toner Cores>

The toner cores contain a binder resin. The toner cores may optionally contain at least one of a colorant, a charge control agent, and a releasing agent.

(Binder Resin)

The binder resin is typically a main component (for example, at least 85% by mass) of the toner cores. Properties of the binder resin are therefore expected to have great influence on an overall property of the toner cores.

As described above, the binder resin preferably has an acid value of at least 1 mgKOH/g and no greater than 10 mgKOH/g. More preferably, the binder resin is at least one of a polyester resin and a styrene-acrylic acid-based resin. A non-crystalline polyester resin or a combination of a non-crystalline polyester resin and a crystalline polyester resin may be used as the polyester resin. The polyester resin and the styrene-acrylic acid-based resin are mainly described below.

(Binder Resin: Polyester Resin)

The polyester resin is a copolymer of at least one alcohol and at least one carboxylic acid. Examples of alcohols that can be used for synthesis of the polyester resin include dihydric alcohols and tri- or higher-hydric alcohols listed below. Examples of dihydric alcohols that can be used include diols and bisphenols. Examples of carboxylic acids that can be used for synthesis of the polyester resin include dibasic carboxylic acids and tri- or higher-basic carboxylic acids listed below.

Preferable examples of the diols include aliphatic diols. Preferable examples of the aliphatic diols include diethylene glycol, triethylene glycol, neopentyl glycol, 1,2-propanediol, α,ω-alkanediols, 2-butene-1,4-diol, 1,4-cyclohexanedimethanol, dipropylene glycol, polyethylene glycol, polypropylene glycol, and polytetramethylene glycol. Preferable examples of the α,ω-alkanediols include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol.

Preferable examples of the bisphenols include bisphenol A, hydrogenated bisphenol A, bisphenol A ethylene oxide adduct, and bisphenol A propylene oxide adduct.

Preferable examples of the tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of the dibasic carboxylic acids include aromatic dicarboxylic acids, α,ω-alkanedicarboxylic acids, unsaturated dicarboxylic acids, and cycloalkane dicarboxylic acids. Preferable examples of the aromatic dicarboxylic acids include phthalic acid, terephthalic acid, and isophthalic acid. Preferable examples of the α,ω-alkanedicarboxylic acids include malonic acid, succinic acid, succinic anhydride, succinic acid derivatives, adipic acid, suberic acid, azelaic acid, sebacic acid, and 1,10-decanedicarboxylic acid. Preferable examples of the succinic acid derivatives include alkyl succinic acids and alkenyl succinic acids. Preferable examples of the alkyl succinic acids include n-butylsuccinic acid, isobutylsuccinic acid, n-octylsuccinic acid, n-dodecylsuccinic acid, and isododecylsuccinic acid. The alkyl succinic acids also include anhydrides of the alkyl succinic acids listed above. Preferable examples of the alkenyl succinic acids include n-butenylsuccinic acid, isobutenylsuccinic acid, n-octenylsuccinic acid, n-dodecenylsuccinic acid, and isododecenylsuccinic acid. The alkenyl succinic acids also include anhydrides of the alkenyl succinic acids listed above. Preferable examples of the unsaturated dicarboxylic acids include maleic acid, fumaric acid, citraconic acid, itaconic acid, and glutaconic acid. A preferable example of the cycloalkane dicarboxylic acids is cyclohexanedicarboxylic acid.

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

(Binder Resin: Crystalline Polyester Resin)

The crystalline polyester resin preferably contains an α,ω-alkanediol having a carbon number of at least 2 and no greater than 8 as an alcohol component. The α,ω-alkanediol preferably includes two α,ω-alkanediols, for example. More specifically, the α,ω-alkanediol preferably includes 1,4-butanediol having 4 carbons and 1,6-hexanediol having 6 carbons.

The crystalline polyester resin preferably contains an α,ω-alkane dicarboxylic acid having a carbon number of at least 4 and no greater than 10 (including carbons of the two carboxyl groups) as an acid component. The α,ω-alkane dicarboxylic acid is preferably a succinic acid having 4 carbons, for example.

More preferably, the crystalline polyester resin has a melting point (Mp) of at least 50° C. and no greater than 100° C. When the crystalline polyester resin has a melting point of at least 50° C. and no greater than 100° C., a toner further excellent in low-temperature fixability and high-temperature preservation stability can be provided.

The amount of the crystalline polyester resin contained in each of the toner cores is preferably at least 1% by mass and no greater than 50% by mass relative to a total mass of the polyester resins contained in each of the toner cores (total mass of the crystalline polyester resin and the non-crystalline polyester resin) and more preferably at least 5% by mass and no greater than 25% by mass. In a configuration for example in which the total mass of the polyester resins contained in each of the toner cores is 100 g, the amount of the crystalline polyester resin contained in each of the toner cores is preferably at least 1 g and no greater than 50 g (more preferably at least 5 g and no greater than 25 g). The above setting can result in provision of a toner further excellent in low-temperature fixability and high-temperature preservation stability.

(Binder Resin: Non-Crystalline Polyester Resin)

The non-crystalline polyester resin preferably contains a bisphenol as an alcohol component. The bisphenol is preferably for example at least one of bisphenol A ethylene oxide adduct and bisphenol A propylene oxide adduct.

The non-crystalline polyester resin preferably contains at least one of an aromatic dicarboxylic acid and an unsaturated dicarboxylic acid as an acid component. A preferable example of the aromatic dicarboxylic acid is terephthalic acid. A preferable example of the unsaturated dicarboxylic acid is fumaric acid.

(Binder Resin: Styrene-Acrylic Acid-Based Resin)

The styrene-acrylic acid-based resin is a copolymer of at least one styrene-based monomer and at least one acrylic acid-based monomer. Styrene-based monomers listed below can be preferably used as a styrene-based monomer used for synthesis of the styrene-acrylic acid-based resin. Acrylic acid-based monomers listed below can also be preferably used as an acrylic acid-based monomer used for synthesis of the styrene-acrylic acid-based resin.

Preferable examples of the styrene-based monomer include styrene, alkyl styrenes, hydroxystyrenes, and halogenated styrenes. Preferable examples of the alkyl styrenes include α-methylstyrene, m-methylstyrene, p-methylstyrene, p-ethylstyrene, and 4-tert-butylstyrene. Preferable examples of the hydroxystyrenes include p-hydroxystyrene and m-hydroxystyrene. Preferable examples of the halogenated styrenes include α-chlorostyrene, o-chlorostyrene, m-chlorostyrene, and p-chlorostyrene.

Preferable examples of the acrylic acid-based monomer include (meth)acrylic acids, (meth)acrylonitrile, alkyl (meth)acrylates, and hydroxyalkyl (meth)acrylates. Preferable examples of the alkyl (meth)acrylates include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Preferable examples of the hydroxyalkyl (meth)acrylates include 2-hydroxyethyl (meth)acrylate, 3-hydroxypropyl (meth) acrylate, 2-hydroxypropyl (meth)acrylate, and 4-hydroxybutyl (meth)acrylate.

(Binder Resin: Other Resins)

Use of plural types of resins as the binder resin can result in adjustment of properties (specifically, hydroxyl value, acid value, glass transition point, and softening point) of the binder resin. When the binder resin has for example an ester group, a hydroxyl group, an ether group, an acid group, or a methyl group, the toner cores have a strong tendency to be anionic. Alternatively, when the binder resin has an amino group or an amide group, the toner cores have a strong tendency to be cationic.

The binder resin preferably contains a thermoplastic resin. Examples of thermoplastic resins that can be used include styrene-based resin, acrylic acid-based resin, olefin-based resin, vinyl resin, polyamide resin, and urethane resin in addition to the crystalline polyester resin, the non-crystalline polyester resin, and the styrene-acrylic acid-based resin. The styrene-based monomers listed above in (Binder Resin: Styrene-acrylic Acid-based Resin) can be each used for example as a styrene-based resin monomer constituting the styrene-based resin. The acrylic acid-based monomers listed above in (Binder Resin: Styrene-acrylic Acid-based Resin) can be each used as an acrylic acid-based monomer constituting the acrylic acid-based resin. A polyethylene resin or a polypropylene resin can be used for example as the olefin-based resin. Examples of vinyl resins that can be used include vinyl chloride resin, polyvinyl alcohol, vinyl ether resin, and N-vinyl resin. Copolymers of the above resins, that is, copolymers of the above resins into which any constitutional unit is introduced can be used as the thermoplastic resin forming the toner particles. For example, a styrene-butadiene-based resin can be used as the thermoplastic resin forming the toner cores.

(Colorant)

The colorant can be a known pigment or dye that matches the color of the toner. The amount of the colorant is preferably at least 1 part by mass and no greater than 20 parts by mass relative to 100 parts by mass of the binder resin in order that a high-quality image is formed using the toner.

The toner cores may contain a black colorant. Carbon black can for example be used as a black colorant. Alternatively, a colorant can be used that has been adjusted to a black color using colorants such as a yellow colorant, a magenta colorant, and a cyan colorant.

The toner cores may contain a non-black colorant such as a yellow colorant, a magenta colorant, or a cyan colorant.

Examples of yellow colorants that can be used include at least one compound selected from the group consisting of condensed azo compounds, isoindolinone compounds, anthraquinone compounds, azo metal complexes, methine compounds, and arylamide compounds. Specific examples of the yellow colorants that can be used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Specific examples of magenta colorants that can be used include at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorants that can be used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include at least one compound selected from the group consisting of copper phthalocyanine compounds, anthraquinone compounds, and basic dye lake compounds. Specific examples of the cyan colorants that can be used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The releasing agent is for example used in order to improve fixability of the toner or resistance of the toner to being offset. An anionic wax is preferably used for producing highly anionic toner cores. The amount of the releasing agent is preferably at least 1 part by mass and no greater than 30 parts by mass relative to 100 parts by mass of the binder resin in order to improve fixability or offset resistance of the toner.

Preferable examples of the releasing agent include aliphatic hydrocarbon waxes, plant waxes, animal waxes, mineral waxes, waxes containing a fatty acid ester as a major component, and waxes in which a part or all of a fatty acid ester has been deoxidized. Preferable examples of the aliphatic hydrocarbon waxes include low molecular weight polyethylene, low molecular weight polypropylene, polyolefin copolymer, polyolefin wax, microcrystalline wax, paraffin wax, and Fischer-Tropsch wax. The aliphatic hydrocarbon waxes include oxides of those listed above. Preferable examples of the plant waxes include candelilla wax, carnauba wax, Japan wax, jojoba wax, and rice wax. Preferable examples of the animal waxes include beeswax, lanolin, and spermaceti. Preferable examples of the mineral waxes include ozokerite, ceresin, and petrolatum. Preferable examples of the waxes containing a fatty acid ester as a major component include montanic acid ester wax and castor wax. A single releasing agent may be used or a combination of two or more releasing agents may be used.

A compatibilizer may be added to the toner cores in order to improve compatibility between the binder resin and the releasing agent.

(Charge Control Agent)

The charge control agent is for example used in order to improve charge stability or a charge rise characteristic of the toner. The charge rise characteristic of the toner is an indicator as to whether the toner can be charged to a specific charge level in a short period of time.

The anionic strength of the toner cores can be increased through the toner cores containing a negatively chargeable charge control agent. In reverse, the cationic strength of the toner cores can be increased through the toner cores containing a positively chargeable charge control agent. However, the toner cores need not contain a charge control agent in a configuration in which sufficient chargeability of the toner can be ensured.

<Shell Layers>

The shell layers contain the specific vinyl resin. Preferably, the shell layers contain the specific vinyl resin and the different resin A.

(Specific Vinyl Resin)

The specific vinyl resin includes the constitutional unit (1-1), the constitutional unit (1-2), and the constitutional unit (1-3). The specific vinyl resin may optionally include a constitutional unit derived from a vinyl compound different from the vinyl compound (1-4). The vinyl compound different from the vinyl compound (1-4) is preferably at least one of the styrene-based monomers and the acrylic acid-based monomers listed above in (Binder Resin: Styrene-acrylic Acid-based Resin).

(Different Resin A)

The different resin A preferably contains a positively chargeable resin and a hydrophobic resin.

(Different Resin A: Positively Chargeable Resin)

The positively chargeable resin is preferably a thermoplastic resin and further preferably includes a constitutional unit derived from a monomer having a positively chargeable functional group. More specifically, the positively chargeable resin is preferably a copolymer of an acrylic acid-based monomer and a monomer having a positively chargeable functional group.

A preferable example of monomers having a positively chargeable functional group that can be used as a monomer constituting the positively chargeable resin is a nitrogen-containing vinyl compound. Examples of the nitrogen-containing vinyl compound include benzyl decyl hexyl methyl ammonium salt, decyl trimethyl ammonium salt, and (meth)acryloyl group-containing quaternary ammonium salt. The (meth)acryloyl group-containing quaternary ammonium salt is preferably (meth)acrylamide alkyltrimethyl ammonium salt or (meth)acryloyloxyalkyl trimethyl ammonium salt, for example. More specifically, the (meth) acrylamide alkyl trimethyl ammonium salt is preferably (3-acrylamide propyl)trimethyl ammonium chloride, for example. Further specifically, the (meth)acryloyloxyalkyl trimethyl ammonium salt is preferably 2-(methacryloyloxy) ethyl trimethylammonium chloride, for example.

Preferable examples of acrylic acid-based monomers that can be used as the monomer constituting the positively chargeable resin include the acrylic acid-based monomers listed above in (Binder Resin: Styrene-acrylic Acid-based Resin).

(Different Resin A: Hydrophobic Resin)

The hydrophobic resin is preferably a thermoplastic resin. More preferably, the hydrophobic resin is at least one of styrene resins, acrylic acid-based resins, and styrene-acrylic acid-based resins. More specifically, a monomer constituting the hydrophobic resin is preferably at least one of styrene-based monomers and acrylic acid-based monomers. Preferable examples of styrene-based monomers that can be used as the monomer constituting the hydrophobic resin include styrene, alkyl styrene, and halogenated styrene among the styrene-based monomers listed above in (Binder Resin: Styrene-acrylic Acid-based Resin). Preferable examples of acrylic acid-based monomers that can be used as the monomer constituting the hydrophobic resin include (meth)acrylonitrile and alkyl (meth)acrylate among the acrylic acid-based monomers listed above in (Binder Resin: Styrene-acrylic Acid-based Resin). More specifically, preferable examples of the hydrophobic resin include a copolymer of styrene and n-butyl (meth)acrylate, a copolymer of styrene, n-butyl (meth)acrylate, and hydroxyalkyl (meth)acrylate, and a copolymer of styrene, n-butyl (meth)acrylate, and acrylonitrile.

<First External Additive Particles>

The content of the first external additive particles in the toner particles is preferably at least 0.1 parts by mass and no greater than 10 parts by mass relative to 100 parts by mass of the toner cores. The above setting can result in provision of a toner further excellent in heat resistance and thermal-stress resistance.

The resin B preferably contains at least one of a polyester resin and a styrene-acrylic acid-based resin. The polyester resin may be a non-crystalline polyester resin or a combination of a non-crystalline polyester resin and a crystalline polyester resin. More specifically, examples of alcohols that can be used for synthesis of the polyester resin include the dihydric alcohols and the tri- or higher-hydric alcohols listed above in (Binder Resin: Polyester Resin). Examples of carboxylic acids that can be used for synthesis of the polyester resin include the dibasic carboxylic acids and tri- or higher-basic carboxylic acids listed above in (Binder Resin: Polyester Resin).

Examples of styrene-based monomers that can be used for synthesis of the styrene-acrylic acid-based resin include the styrene-based monomers listed above in (Binder Resin: Styrene-acrylic Acid-based Resin). The acrylic acid-based monomer used for synthesis of the styrene-acrylic acid-based resin preferably contains (meth)acrylic acid. Examples of acrylic acid-based monomers that can be used for synthesis of the styrene-acrylic acid-based resin include (meth)acrylonitrile, alkyl (meth)acrylate, and hydroxyalkyl (meth)acrylate among the acrylic acid-based monomers listed above in (Binder Resin: Styrene-acrylic Acid-based Resin) in addition to the (meth)acrylic acid.

According to the toner in the present disclosure, detachment of the first external additive particles from the toner mother particles can be inhibited and contamination of members of an image forming apparatus by the first external additive particles can be prevented without involving impairment of heat resistance and low-temperature fixability of the toner.

EXAMPLES

Examples of the present disclosure will be described. Table 1 lists configurations of respective toners of Examples and Comparative Examples. Table 2 indicates respective constituents of the toner cores of Examples and Comparative Examples.

TABLE 1

| Toner | Toner core | External additive suspension | Liquid for shell layer formation: Vinyl resin | Suspension: Positively chargeable | Suspension: Hydrophobic |
|---|---|---|---|---|---|
| T-1 | TC-1 | R-1 | Blended | Blended | Blended |
| T-2 | TC-1 | R-1 | | | |
| T-3 | TC-1 | R-1 | | | |
| T-4 | TC-1 | R-1 | | | |
| T-5 | TC-1 | R-1 | | | |
| T-6 | TC-1 | R-2 | | | |
| T-7 | TC-2 | R-1 | | | |
| T-8 | TC-1 | R-1 | Not blended | Blended | Blended |
| T-9 | TC-3 | R-1 | Blended | | |
| T-10 | TC-1 | R-3 | Blended | | |

"External additive suspension" in Table 1 refers to a suspension containing the first external additive particles. Constituents of the external additive suspension are as listed in Table 4. Whether or not an aqueous solution of oxazoline group-containing macromolecule ("EPOCROS WS-300" produced by NIPPON SHOKUBAI CO., LTD.) was blended in (1-2. Shell Layer Formation) described below is indicated in "Vinyl Resin". When it was blended, "Blended" is indicated. When it was not blended, "Not blended" is indicted.

"Positively chargeable suspension" refers to a suspension containing particles made from a positively chargeable resin. Whether or not a positively chargeable suspension was blended in (1-2. Shell Layer Formation) described below is indicated in "Positively chargeable". "Blended" indicates that the positively chargeable suspension was blended.

"Hydrophobic suspension" refers to a suspension containing particles made from a hydrophobic resin. Whether or not a hydrophobic suspension was blended in (1-2. Shell Layer Formation) described below is indicated in "Hydrophobic". "Blended" indicates that the hydrophobic suspension was blended.

TABLE 2

| Binder resin of toner cores | Blended amount (part by mass) | | | |
|---|---|---|---|---|
| Type | PES-1 | PES-2 | SA-1 | SA-2 |
| TC-1 | 80.0 | 20.0 | 0.0 | 0.0 |
| TC-2 | 0.0 | 0.0 | 100.0 | 0.0 |
| TC-3 | 0.0 | 0.0 | 0.0 | 100.0 |

"PES-1", "PES-2", "SA-1", and "SA-2" in Table 2 each are as indicted in Table 3.

TABLE 3

| | Material | Acid value (mgKOH/g) |
|---|---|---|
| PES-1 | Non-crystalline polyester resin | 6.0 |
| PES-2 | Crystalline polyester resin | 3.1 |
| SA-1 | Styrene-acrylic acid-based resin | 7.2 |
| SA-2 | Styrene-acrylic acid-based resin | 0.0 |

TABLE 4

| External additive suspension | | | | |
|---|---|---|---|---|
| Type | Material | Acid value (mgKOH/g) | Particle diameter (nm) | Tg (° C.) |
| R-1 | Styrene-acrylic acid-based resin | 32.6 | 25 | 132 |
| R-2 | Styrene-acrylic acid-based resin | 13.0 | 20 | 138 |
| R-3 | Styrene-acrylic acid-based resin | 0.0 | 32 | 145 |

"Acid value" in Table 4 refers to an acid value of the first external additive particles contained in the external additive suspension. "Particle diameter" refers to a number average primary particle diameter of the first external additive particles contained in the external additive suspension. "Tg" refers to a glass transition point of the first external additive particles contained in the external additive suspension.

The following describes production methods, evaluation methods, and evaluation results for toners T-1 to T-10 according to Examples and Comparative Examples (each is an electrostatic latent image developing toner) in stated order. In evaluation in which errors may occur, an evaluation value was calculated by calculating the arithmetic mean of an appropriate number of measured values in order to ensure that any errors were sufficiently small.

[Method for Synthesizing Binder Resin]

(Method for Synthesizing Non-Crystalline Polyester Resin PES-1)

A four-necked flask (capacity: 5 L) equipped with a thermometer (specifically, a thermocouple), a dewatering conduit, a nitrogen inlet tube, and a stirrer was charged with 1,700 g of bisphenol A propylene oxide adduct, 650 g of bisphenol A ethylene oxide adduct, 500 g of n-dodecenyl succinic anhydride, 400 g of terephthalic acid, and 4 g of dibutyl tin oxide. The internal temperature of the flak was increased up to 220° C. The flask contents were allowed to react over nine hours while the internal temperature of the flask was kept at 220° C. The internal pressure of the flask was reduced to 8 kPa. The flask contents were allowed to further react in a high-temperature and reduced-pressure environment (temperature: 220° C., pressure: 8 kPa). Through the above, a non-crystalline polyester resin PES-1 was obtained. The non-crystalline polyester resin PES-1 had a softening point (Tm) of 124.8° C., a glass transition point (Tg) of 57.2° C., an acid value of 6.0 mgKOH/g, a hydroxyl value of 41 mgKOH/g, a number average molecular weight (Mn) of 3,737, and a mass average molecular weight (Mw) of 109,475.

(Method for Synthesizing Crystalline Polyester Resin PES-2)

A four-necked flask (capacity: 5 L) equipped with a thermometer (specifically, a thermocouple), a dewatering conduit, a nitrogen inlet tube, and a stirrer was charged with 990.0 g (84 parts by mole) of 1,4-butanediol, 242.0 g (11 parts by mole) of 1,6-hexanediol, 1,480.0 g (100 parts by mole) of fumaric acid, and 2.5 g of 1,4-benzenediol. The internal temperature of the flask was increased up to 170° C. The flask contents were allowed to react over five hours while the internal temperature of the flask was kept at 170° C. The internal temperature of the flask was increased up to 210° C. The flask contents were allowed to react over 1.5 hours while the internal temperature of the flask was kept at 210° C. The internal pressure of the flask was then reduced to 8 kPa. The flask contents were allowed to further react over one hour in a high-temperature and reduced-pressure environment (temperature: 210° C., pressure: 8 kPa).

The internal pressure of the flask was returned to normal pressure. Then, 69.0 g (2.8 parts by mole) of styrene and 54.0 g (2.2 parts by mole) of n-butyl methacrylate were added to the flask. The flask contents were allowed to react over 1.5 hours while the internal temperature of the flask was kept at 210° C. The internal pressure of the flask was then reduced to 8 kPa. The flask contents were allowed to further react over one hour in a high-temperature and reduced-pressure environment (temperature: 210° C., pressure: 8 kPa). Through the above, a crystalline polyester resin PES-2 was obtained. The crystalline polyester resin PES-2 had a Tm of 88.8° C., a melting point (Mp) of 82° C., an acid value of 3.1 mgKOH/g, a hydroxyl value of 19 mgKOH/g, a Mn of 3,620, and a Mw of 27,500.

(Method for Synthesizing Styrene-Acrylic Acid-Based Resin SA-1).

A four-necked flask (capacity: 5 L) equipped with a thermometer (specifically, a thermocouple), a dewatering conduit, a nitrogen inlet tube, and a stirrer was charged with 2 L of ion-exchanged water and 5.0 g of tricalcium phosphate (production of TAIHEI CHEMICAL INDUSTRIAL CO.). Furthermore, 700.0 g of styrene, 270.0 g of n-butyl acrylate, 4.5 g of divinylbenzene, 30.0 g of acrylic acid, and a liquid constituting an oil phase were added to the flask while the flask contents were stirred at a rotational speed of 50 rpm. In the liquid constituting the oil phase, 15.0 g of 2,2'-azobis(2,4-dimethyl valeronitrile) was dissolved in 25.0 g of diethylene glycol. The internal temperature of the flask was increased up to 80° C. Polymerization reaction of the flask contents was caused over eight hours while the internal temperature of the flask was kept at 80° C. Through the above, a styrene-acrylic acid-based resin SA-1 in the form of bead-shaped particles was obtained. The styrene-acrylic acid-based resin SA-1 had a Tm of 102.3° C., a Tg of 40.3° C., an acid value of 7.2 mgKOH/g, a Mn of 2,680, and a Mw of 131,026.

(Method for Synthesizing Styrene-Acrylic Acid-Based Resin SA-2)

A four-necked flask (capacity: 5 L) equipped with a thermometer (specifically, a thermocouple), a dewatering conduit, a nitrogen inlet tube, and a stirrer was charged with 2 L of ion-exchanged water and 5.0 g of tricalcium phosphate (production of TAIHEI CHEMICAL INDUSTRIAL CO.). Furthermore, 730.0 g of styrene, 270.0 g of n-butyl acrylate, 4.5 g of divinylbenzene, and a liquid constituting an oil phase were added to the flask while the flask contents were stirred at a rotational speed of 50 rpm. In the liquid constituting the oil phase, 15.0 g of 2,2'-azobis(2,4-dimethyl valeronitrile) was dissolved in 25.0 g of diethylene glycol. The internal temperature of the flask was increased up to 80° C. Polymerization reaction of the flask contents was caused over eight hours while the internal temperature of the flask was kept at 80° C. Through the above, a styrene-acrylic acid-based resin SA-2 in the form of bead-shaped particles was obtained. The styrene-acrylic acid-based resin SA-2 had a Tm of 110.3° C., a Tg of 41.5° C., an acid value of 0.0 mgKOH/g, a Mn of 2,740, and a Mw of 120,263.

[Method for Measuring Acid Value of Binder Resin]

The acid values of the respective binder resins were measured in accordance with a method described in "JIS K0070-1992". Specifically, 20 g of a binder resin (measurement sample) was added to an Erlenmeyer flask. Furthermore, 100 mL of a solvent and several drops of a phenolphthalein solution (indicator) were added to the Erlenmeyer flask. In a situation in which the respective acid values of the non-crystalline polyester resin PES-1 and the crystalline polyester resin PES-2 were measured, a mixed liquid of acetone and toluene [volume ratio of acetone to toluene=1:1] was used as the solvent. In a situation in which the respective acid values of the styrene-acrylic acid-based resins SA-1 and SA-2 were measured, a mixed liquid of diethyl ether and ethanol [volume ratio of diethyl ether to ethanol=2:1] was used as the solvent.

The measurement sample was dissolved in the solvent by shaking the Erlenmeyer flask in a water bath. The liquid in the Erlenmeyer flask was then titrated using 0.1 mol/L of a solution of potassium hydroxide ethanol. The acid value (unit: mgKOH/g) was calculated from the titration result according to the following (Equation 1).

$$(\text{Acid value})=(B\times f1\times 5.611)/W1 \quad \text{(Equation 1).}$$

In (Equation 1) above, "B" represents an amount (unit: mL) of the 0.1-mol/L potassium hydroxide ethanol solution used in the titration. Also, "f1" represents a factor of the 0.1-mol/L potassium hydroxide ethanol solution. "W1" represents an amount (unit: g) of the measurement sample. Furthermore, "5.611" is equivalent to a formula weight of potassium hydroxide of 56.11×(1/10).

Note that the factor (f1) was calculated according to the following method. An Erlenmeyer flask was charged with 25 mL of 0.1-mol/L hydrochloric acid. A phenolphthalein solution was added to the Erlenmeyer flask. The liquid in the Erlenmeyer flask was titrated using 0.1 mol/L of a potassium hydroxide ethanol solution. The factor (f1) was calculated from an amount of the 0.1-mol/L potassium hydroxide ethanol solution necessary for neutralization.

[Method for Producing External Additive Suspension]

(Method for Producing External Additive Suspension R-1)

A round-bottom flask equipped with an anchor stirrer was charged with 60.0 parts by mass of styrene, 25.0 parts by mass of methyl methacrylate, 5.0 parts by mass of methacrylic acid, 10.0 parts by mass of divinylbenzene, 4.5 parts by mass of potassium peroxodisulfate (a water-soluble polymerization initiator), and 100.0 parts by mass of ion-exchanged water. The internal temperature of the round-bottom flask was increased up to 70° C. while the contents of the round-bottom flask were stirred at 100 rpm. Emulsion polymerization of the contents of the round-bottom flask was caused over eight hours while the contents of the round-bottom flask were kept at 70° C. Through the above, a dispersion of organic fine particles was obtained. The resulting dispersion was filtered and a solid obtained by the filtration was washed. The washed solid was dispersed in an aqueous solution of sodium alkyl ether sulfate (concentration: 10% by mass). Through the above, a dispersion of the first external additive particles (solid concentration: 8% by mass) was obtained.

(Method for Producing External Additive Suspension R-2)

A round-bottom flask equipped with an anchor stirrer was charged with 60.0 parts by mass of styrene, 28.0 parts by mass of methyl methacrylate, 2.0 parts by mass of methacrylic acid, 10.0 parts by mass of divinylbenzene, 4.5 parts by mass of potassium peroxodisulfate (a water-soluble polymerization initiator), and 100.0 parts by mass of ion-exchanged water. Thereafter, the same method as that for producing the external additive suspension R-1 was followed to obtain an external additive suspension R-2.

(Method for Producing External Additive Suspension R-3)

A round-bottom flask equipped with an anchor stirrer was charged with 60.0 parts by mass of styrene, 30.0 parts by mass of methyl methacrylate, 10.0 parts by mass of divinylbenzene, 4.5 parts by mass of potassium peroxodisulfate (a water-soluble polymerization initiator), and 100.0 parts by mass of ion-exchanged water. Thereafter, the same method as that for producing the external additive suspension R-1 was followed to obtain an external additive suspension R-3.

[Method for Measuring Property Values of First External Additive Particles Contained in External Additive Suspension]

The acid values of the first external additive particles contained in the respective external additive suspensions R-1 to R-3 were measured according to the method described above in [Method for Measuring Acid Value of Binder Resin]. The results were as indicated in Table 4. The number average primary particle diameters of the first external additive particles contained in the respective external additive suspensions R-1 to R-3 were measured using a field emission scanning electron microscope (FE-SEM, "JSM-7600F" produced by JEOL Ltd.). The results were as indicated in Table 4. The glass transition points of the first external additive particles contained in the respective external additive suspensions R-1 to R-3 were also measured using a differential scanning calorimeter ("DSC-6220" produced by Seiko Instruments Inc.). The results were as indicate in Table 4.

Note that the first external additive particles contained in each of the external additive suspensions R-1 to R-3 had a sharp particle size distribution. More specifically, the first external additive particles contained in the external additive suspension R-1 substantially included first external additive particles having a particle diameter of approximately 25 nm. The first external additive particles contained in the external additive suspension R-2 substantially included first external additive particles having a particle diameter of approximately 20 nm. The first external additive particles contained in the external additive suspension R-3 substantially included first external additive particles having a particle diameter of approximately 32 nm.

[Method for Producing Positively Chargeable Suspension]

A three-necked flask (capacity: 1 L) equipped with a thermometer (specifically, a thermocouple), a cooling tube, a nitrogen inlet tube, and a stirrer was charged with 90 g of isobutanol, 100 g of methyl methacrylate, 35 g of n-butyl acrylate, 30 g of 2-(methacryloyloxy)ethyl trimethylammonium chloride (product of Alfa Aesar), and 6 g of a water soluble azo polymerization initiator ("VA-086" produced by Wako Pure Chemical Industries, Ltd.). The internal temperature of the flask was increased up to 80° C. The flask contents were allowed to react in a nitrogen atmosphere over three hours in a state in which the internal temperature of the flask was kept at 80° C.

Furthermore, 3 g of a water soluble azo polymerization initiator ("VA-086" produced by Wako Pure Chemical Industries, Ltd.) was added to the flask. The flask contents were allowed to react in a nitrogen atmosphere over three hours in a state in which the internal temperature of the flask was kept at 80° C. The internal temperature of the flask was increased up to 150° C. and the internal pressure of the flask was set at 0.1 MPa to dry the contents of the flask. The resulting solid was broken up to obtain a resin X.

Subsequently, 200 g of the resin X and 184 mL of ethyl acetate ("ethyl acetate JIS special grade" produced by Wako Pure Chemical Industries, Ltd.) were loaded into a mixer ("HIVIS MIX (registered Japanese trademark) Model 2P-1" produced by PRIMIX Corporation). The contents of the mixer were stirred at a rotational speed of 20 rpm over one hour. Then, 18 mL of hydrochloric acid (concentration: 1N) and a first liquid were added to the resulting solution. The first liquid was a solution in which 20 g of an anionic surfactant ("EMAL (registered Japanese trademark) 0" produced by Kao Corporation) and 16 g of ethyl acetate ("ethyl acetate JIS special grade" produced by Wako Pure Chemical Industries, Ltd.) were dissolved in 562 g of ion-exchanged water. Through the above, a positively chargeable suspension was obtained.

The number average primary particle diameter of the resin particles P1 contained in the positively chargeable suspension was measured using a transmission electron microscope (TEM, "JSM-7600F" produced by JEOL Ltd.). The resin particles P1 had a number average primary particle diameter of 35 nm. The resin particles P1 indicated a sharp particle size distribution and substantially included only resin particles having a particle diameter of approximately 35 nm. The glass transition point of the resin particles P1 contained in the positively chargeable suspension was measured using a differential scanning calorimeter ("DSC-6220" produced by Seiko Instruments Inc.). The resin particles P1 had a glass transition point of 80° C.

[Method for Producing Hydrophobic Suspension]

A three-necked flask (capacity: 1 L) equipped with a thermometer and a stirring impeller was charged with 875 mL of ion-exchanged water and 75 mL of an anionic surfactant ("LATEMUL (registered Japanese trademark) WX" produced by Kao Corporation, component: sodium polyoxyethylene alkyl ether sulfate, solid concentration: 26% by mass). After the flask was set in a water bath, the internal temperature of the flask was kept at 80° C. using the water bath. Second and third liquids were dripped into the flask over five hours in a state in which the internal temperature of the flask was kept at 80° C. The second liquid was constituted by 18 mL of styrene and 2 mL of n-butyl acrylate. The third liquid was a solution in which 0.5 g of potassium peroxodisulfate was dissolved in 30 mL of ion-exchanged water. The flask contents were allowed to react (polymerization reaction) over two hours while the internal temperature of the flask was kept at 80° C. Through the above, a hydrophobic suspension was obtained.

The number average primary particle diameter of the resin particles P2 contained in the hydrophobic suspension was measured using a transmission electron microscope (TEM, "JSM-7600F" produced by JEOL Ltd.). The resin particles P2 had a number average primary particle diameter of 32 nm. The resin particles P2 indicated a sharp particle size distribution and substantially included only resin particles having a particle diameter of approximately 32 nm. The glass transition point of the resin particles P2 contained in the hydrophobic suspension was measured using a differential scanning calorimeter ("DSC-6220" produced by Seiko Instruments Inc.). The resin particles P2 had a glass transition point of 71° C.

[Toner Production Method]

<Production Method of Toner T-1>

First, production of composite particles was performed. External addition was performed then.

(1. Production of Composite Particles)

(1-1. Production of Toner Cores)

An FM mixer ("FM-20B" produced by Nippon Coke & Engineering Co., Ltd.) was used to mix 80.0 parts by mass of the non-crystalline polyester resin PES-1, 20.0 parts by mass of the crystalline polyester resin PES-2, 5.0 parts by mass of an ester wax ("NISSAN ELECTOL (registered Japanese trademark) WEP-3" produced by NOF Corporation), and 6.0 parts by mass of carbon black ("MA100" produced by Mitsubishi Chemical Corporation).

The resulting mixture was melt-kneaded using a two-axis extruder ("PCM-30" produced by Ikegai Corp.) under conditions of a material feeding speed of 6 kg/hour, a shaft rotational speed of 160 rpm, and a setting temperature (cylinder temperature) of 120° C. The resulting melt-kneaded product was cooled. The cooled melt-kneaded product was coarsely pulverized using a pulverizer ("ROTOPLEX (registered Japanese trademark)" produced by Hosokawa Micron Corporation). The resulting coarsely pulverized product was finely pulverized using a pulverizer ("Turbo Mill Type RS" produced by FREUND-TURBO CORPORATION). The resulting finely pulverized product was classified using a classifier ("Elbow Jet Model EJ-LABO" produced by Nittetsu Mining Co., Ltd.). As a result, toner cores TC-1 having a volume median diameter ($D_{50}$) of 7 μm were produced.

(1-2. Shell Layer Formation)

Next, shell layers were formed. Specifically, 300 mL of ion-exchanged water was added to a three-necked flask (capacity: 1 L) equipped with a thermometer and a stirring impeller and the flask was then set in a water bath. The internal temperature of the flask was kept at 30° C. using the water bath. Subsequently, 3.0 g of an aqueous solution of oxazoline group-containing macromolecule ("EPOCROS WS-300" produced by NIPPON SHOKUBAI CO., LTD., solid concentration: 10% by mass, Tg: 90° C.), 75.0 g of the external additive suspension R-1, 220.0 g of the hydrophobic suspension, and 12.0 g of the positively chargeable suspension were added to the flask. Furthermore, 300.0 g of the toner cores TC-1 and 6 mL of ammonia water (concentration: 1% by mass) were added to the flask. Here, the blending amount of the aqueous solution of oxazoline group-containing macromolecule was adjusted so that the content of a solid content of the aqueous solution of oxazoline group-containing macromolecule (specifically, the vinyl resin for formation) relative to 100.0 parts by mass of the toner cores CT-1 was 0.1 parts by mass. Furthermore, the blending amount of the external additive suspension R-1 was adjusted so that the content of a solid content of the external suspension R-1 (specifically, the first external additive particles) relative to 100.0 parts by mass of the toner cores TC-1 was 2.0 parts by mass.

The internal temperature of the flask was increased up to 70° C. at a heating rate of 1° C./minute while the flask contents were stirred at a rotational speed of 100 rpm. The flask contents were stirred at a rotational speed of 100 rpm over two hours in a state in which the internal temperature of the flask was kept at 70° C. The internal temperature of the flask was then cooled to normal temperature. Through the above, a dispersion containing the composite particles was obtained.

(1-3. Washing)

The resulting dispersion was filtered by suction using a Buchner funnel. The resulting wet cake of the composite particles was re-dispersed in ion-exchanged water. The resulting dispersion was filtered by suction using a Buchner funnel. Solid-liquid separation as above was repeated five times.

(1-4. Drying)

The resulting composite particles were dispersed in an ethanol aqueous solution at a concentration of 50% by mass. Through the above dispersion, a slurry of the composite particles was obtained. The composite particles in the slurry were dried using a continuous surface-modifying apparatus ("COATMIZER (registered Japanese trademark)" produced by Freund Corporation) under conditions of a hot wind temperature of 45° C. and a flow rate of 2 $m^3$/minute. Mechanical processing (specifically, processing to apply shear force) was performed on the composite particles using a hermetic flow mixer ("FM-20C/I" produced by Nippon Coke & Engineering Co., Ltd.) under conditions of a rotational speed of 3,000 rpm, a jacket temperature of 20° C., and a processing period of 10 minutes. Through the above, the composite particles were obtained.

(2. External Addition)

An FM mixer ("FM-10B" produced by Nippon Coke & Engineering Co., Ltd.) was charged with 100.0 parts by mass of the composite particles, 1.2 parts by mass of hydrophobic silica particles ("AEROSIL (registered Japanese trademark) RA-200H" produced by Nippon Aerosil Co., Ltd.), and 0.8 parts by mass of conductive titanium oxide particles ("EC-100" produced by Titan Kogyo, Ltd.). The composite particles, the hydrophobic silica particles, and the conductive titanium oxide particles were mixed together under conditions of a rotational speed of 3,000 rpm, a jacket temperature of 20° C., and a processing period of two minutes. Through the above, a toner T-1 including multiple toner particles was produced.

<Production Methods of Toners T-2 and T-3>

Toners T-2 and T-3 were produced according to the same method as the toner T-1 except that the blending ratio of the external additive suspension R-1 described above in (1-2. Shell Layer Formation) was changed.

Specifically, the blending amount of the external additive suspension R-1 was adjusted in production of the toner T-2 so that the content of a solid content of the external additive suspension R-1 (specifically, the first external additive particles) was 1.5 parts by mass relative to 100.0 parts by mass of the toner cores TC-1. The blending ratio of the external additive suspension R-1 was adjusted also in production of the toner T-3 so that the content of the solid content of the external additive suspension R-1 (specifically, the first external additive particles) was 2.3 parts by mass relative to 100.0 parts by mass of the toner cores TC-1.

<Production Methods of Toners T-4 and T-5>

Toners T-4 and T-5 were produced according to the same method as the toner T-1 except that the blending amount of the aqueous solution of oxazoline group-containing macromolecule described above in (1-2. Shell Layer Formation) was changed.

Specifically, 0.3 g of the aqueous solution of oxazoline group-containing macromolecule was blended in production of the toner T-4. In other words, the blending amount of the aqueous solution of oxazoline group-containing macromolecule was adjusted so that a content of the solid content of the aqueous solution of oxazoline group-containing macromolecule (specifically, the vinyl resin for formation) was 0.01 parts by mass relative to 100.0 parts by mass of the toner cores TC-1.

Also, 10.0 g of the aqueous solution of oxazoline group-containing macromolecule was blended in production of the toner T-5. In other words, the blending amount of the aqueous solution of oxazoline group-containing macromolecule was adjusted so that the content of the solid content of the aqueous solution of oxazoline group-containing macromolecule (specifically, the vinyl resin for formation) was 0.3 parts by mass relative to 100.0 parts by mass of the toner cores TC-1.

<Production Method of Toner T-6>

The external additive suspension R-2 was blended instead of the external additive suspension R-1 in (1-2. Shell Layer Formation) described above. A toner T-6 was produced according to the same method as the toner T-1 except the above.

<Production Method of Toner T-7>

Toner cores TC-2 were produced using 100.0 parts by mass of the styrene-acrylic acid-based resin SA-1 as a binder resin. A toner T-7 was produced using the toner cores TC-2. The toner T-7 was produced according to the same method as the toner T-1 except the above.

<Production Method of Toner T-8>

A toner T-8 was produced according to the same method as the method for producing the toner T-1 except that the aqueous solution of oxazoline group-containing macromolecule was not blended in (1-2. Shell Layer Formation) described above.

<Production Method of Toner T-9>

Toner cores TC-3 were produced using 100.0 parts by mass of the styrene-acrylic acid-based resin SA-2 as a binder resin. A toner T-9 was produced using the toner cores TC-3. The toner T-9 was produced according to the same method as the method for producing the toner T-1 except the above.

<Production Method of Toner T-10>

The external additive suspension R-3 was blended instead of the external additive suspension R-1 in (1-2. Shell Layer Formation) described above. A toner T-10 was produced according to the same method as the method for producing the toner T-1 except the above.

[Toner Evaluation Methods]

The presence or absence of the specific covalent bond was confirmed by the following method. Evaluation was further performed of heat resistance and low-temperature fixability of the toners, the presence or absence of toner attachment to the surface of a development sleeve, and detachment ratios of the first external additive particles. The results are indicated in Table 5.

<Method for Confirming Presence or Absence of Specific Covalent Bond>

First, 20 mg of composite particles (a sample) was dissolved in 1 mL of deuterated chloroform. The resulting solution was added to a test tube (diameter: 5 mm). The test tube was put into a Fourier transform nuclear magnetic resonance apparatus (FT-NMR, "JNM-AL400" produced by JEOL Ltd). A $^1$H-NMR spectrum was measured under conditions of a sample temperature of 20° C. and a cumulative number of times of 128. Tetramethylsilane was used as an internal standard substance for chemical shift. When the presence of a triplet signal was confirmed around a chemical shift δ of 6.5 in the resulting $^1$H-NMR spectrum, it was inferred that the specific covalent bond was present. That is, when a triplet signal was observed around a chemical shift δ of 6.5, it was inferred that an amide bond (first amide bond) included in the constitutional unit (1-1) and an amide bond (second amide bond) included in the constitutional unit (1-2) were present. Furthermore, when a triplet signal was observed around a chemical shift δ of 6.5, it was inferred that the constitutional units (1-1) and (1-2) were included in the vinyl resin. In a situation in which the aqueous solution of oxazoline group-containing macromolecule was blended in (1-2. Shell Layer Formation) described above (that is, in a case where "Blended" is indicated in "Vinyl resin" in Table 1), the constitutional unit (1-3) was included in the vinyl resin.

<Method for Evaluating Heat Resistance of Toner>

A polyethylene container (capacity: 20 mL) was charged with 3 g of a toner (any of the toners T-1 to T-10). The container was sealed and left to stand for three hours in a thermostatic chamber set at 58° C. The container was then taken out from the thermostatic chamber and cooled to room temperature (approximately 25° C.), thereby obtaining an evaluation toner.

The resulting evaluation toner was placed on a 200-mesh sieve (opening: 75 μm) of known mass. The mass of the toner prior to sifting was calculated by measuring the total mass of the sieve and the evaluation toner thereon. The sieve was placed in a POWDER TESTER ((registered Japanese trademark) that is a product of Hosokawa Micron Corporation) and the evaluation toner was sifted in accordance with a manual of the powder tester by shaking the sieve for 30 seconds at a rheostat level of 5. After the sifting, the mass of the toner that did not pass through the sieve was measured. A toner aggregation rate (unit: %) was calculated using the following equation based on the mass of toner before the sifting and the mass of toner after the sifting. The "mass of toner after the sifting" in the following equation was a mass of toner not having passed through the sieve and remaining on the sieve after the sifting.

$$(\text{Toner aggregation rate})=100\times(\text{mass of toner after sifting})/(\text{mass of toner before sifting})$$

A toner having a toner aggregation rate of no greater than 10% was evaluated as very good. A toner having a toner aggregation rate of greater than 10% and no greater than 20% was evaluated as good.

<Method for Evaluating Low-Temperature Fixability of Toner>

(Evaluation Target Preparing Method)

A toner (any of the toners T-1 to T-10) and a carrier (carrier for "TASKalfa5550ci" produced by KYOCERA Document Solutions Inc.) were put into a ball mill such that the content of the toner was 10% by mass, and mixed together over 30 minutes. Through the mixing, an evaluation target was obtained.

(Evaluation Apparatus Preparing Method)

A printer ("FS-C5250DN" produced by KYOCERA Document Solutions Inc.) was modified to be capable of adjusting fixing temperature for use as an evaluation apparatus. The evaluation target (unused) was loaded in a developing device of the evaluation apparatus and toner for replenishment (unused) was loaded in a toner container of the evaluation apparatus. In Examples, the same toner as a toner included in the evaluation target was used as the toner for replenishment. Through the above, the evaluation apparatus was prepared.

(Measurement of Minimum Fixing Temperature)

Minimum fixing temperature was measured by the following method. The minimum fixing temperature herein refers to the lowest temperature among fixing temperatures for which it was determined that low temperature offset did not occur.

Specifically, the bias of the valuation apparatus was adjusted so that 1.0 mg/cm$^2$ of toner was applied onto recording paper. An unfixed solid image was formed on printing paper (printing paper of 90 g/m$^2$) while the printing paper was conveyed at a linear velocity of 200 mm/second.

The printing paper having the unfixed solid image formed thereon was caused to pass through a fixing device of the evaluation apparatus. In doing so, the temperature of the fixing device of the evaluation apparatus (specifically, temperature of a fixing roller included in the fixing device of the evaluation apparatus) was increased from 100° C. in increments of 5° C. to increase the fixing temperature in increments of 5° C. in a range from 100° C. to 200° C. Through the above, solid images (21 types) fixed at the respective fixing temperatures were obtained.

A fold-rubbing test was performed on each of the obtained solid images to determine whether or not low temperature offset occurs. Specifically, the recording paper having a solid image fixed thereto was folded in half with a surface on which the image was formed facing inward. A 1-kg weight covered with cloth was rubbed back and forth on the fold of the recording paper five times. The recording paper was open up and the length of peeling of the toner (also referred to below as peeling width) in a part of the folded portion of the recording paper to which the solid image was fixed was measured. When the pealing width was less than 1.0 mm, it was determined that no low temperature offset occurred. When the pealing width was at least 1.0 mm, it was determined that low temperature offset occurred. In a manner as above, the minimum fixing temperature was obtained. A toner for which the minimum fixing temperature was no greater than 145° C. was evaluated as very excellent in low-temperature fixability. A toner for which the minimum fixing temperature was greater than 145° C. and no greater than 155° C. was evaluated as excellent in low-temperature fixability.

<Method for Evaluating Presence or Absence of Contamination by First External Additive Particles>

The evaluation target prepared in <Method for Evaluating Low-Temperature Fixability of Toner> was used as an evaluation target. A printer ("TASKalfa5550ci" produced by KYOCERA Document Solutions Inc.) was used as an evaluation apparatus. The evaluation target (unused) was loaded in a developing device of the evaluation apparatus and toner for replenishment (unused) was loaded in a toner container of the evaluation apparatus. In Examples, the same toner as that included in the evaluation target was used as the toner for replenishment. Through the above, the evaluation apparatus was prepared.

A printing durability test in which a sample image at a printing rate of 5% was successively printed on 20,000 sheets of printing paper (A4 size) was performed using the evaluation apparatus in an environment at a temperature of 32° C. and a relative humidity of 80%. In the printing, a solid image was output each time the number of times of sample image printing reached 200 until the number of times of sample image printing reached 1,000. After the number of times of sample image printing exceeded 1,000, a solid image was output each time the number of times of sample image printing reached 1,000. Each time the solid image was output, a development sleeve of the evaluation apparatus was taken out from the evaluation apparatus and whether or not extraneous matter was present on the surface of the development sleeve was visually checked. A toner was evaluated as good when no extraneous matter was observed on the surface of the development sleeve after the number of times of sample image printing reached 20,000. A toner was evaluated as poor when extraneous matter was observed on the surface of the development sleeve before the number of times of sample image printing reached 20,000.

<Method for Evaluating Detachment Ratio of First External Additive Particles>

A measurement sample was prepared by adding 2 g of a toner (any of the toners T-1 to T-10) to 500 mL of an aqueous solution of a surfactant. The aqueous solution of the surfactant contained ion-exchanged water and 0.2% by mass of sodium alkyl ether sulfate.

The measurement sample was vacuum dehydrated using filter cloth (opening diameter: 2 μm) and dried using a vacuum oven. The infrared absorption spectrum of the measurement sample was measured using a Fourier transform infrared (FT-IR) spectroscopic analysis apparatus ("Spectrum One (Frontier series)" produced by PerkinElmer Japan Co., Ltd.). A peak area of a peak derived from the resin contained in each of the first external additive particles was calculated from the measured infrared absorption spectrum. Through the above, an initial peak area was obtained.

The measurement sample was irradiated with a ultrasonic (high frequency output: 100 W, oscillation frequency: 50 kHz) over ten minutes using a ultrasonic liquid mixer (Ultrasonic Cleaner, "Supersonic VS-F100" available at AS ONE Corporation). Thereafter, a peak area after the irradiation was obtained by the same method as that for obtaining the initial peak area. The detachment ratio of the first external additive particles (unit: %) was calculated using the following equation (A) based on the initial peak area and the peak area after irradiation.

(Detachment ratio of first external additive particles) =((initial peak area)−(peak area after irradiation))×100/(initial peak area) Equation (A).

A toner including the first external additive particles having a detachment ratio of less than 5% was evaluated as good. A toner including the first external additive particles having a detachment ratio of at least 5% was evaluated as poor.

TABLE 5

| | Toner | NMR | Aggregation rate (%) | Minimum fixing temperature (° C.) | Contamination | Detachment ratio (%) |
|---|---|---|---|---|---|---|
| Example 1 | T-1 | Confirmed | 7 | 150 | Not observed | 3.2 |
| Example 2 | T-2 | Confirmed | 10 | 145 | Not observed | 2.0 |
| Example 3 | T-3 | Confirmed | 2 | 155 | Not observed | 4.5 |
| Example 4 | T-4 | Confirmed | 12 | 155 | Not observed | 4.3 |
| Example 5 | T-5 | Confirmed | 5 | 145 | Not observed | 0.8 |
| Example 6 | T-6 | Confirmed | 8 | 155 | Not observed | 2.6 |
| Example 7 | T-7 | Confirmed | 10 | 155 | Not observed | 3.7 |
| Comparative Example 1 | T-8 | Not confirmed | 15 | 145 | Observed | 8.8 |
| Comparative Example 2 | T-9 | Not confirmed | 16 | 145 | Observed | 7.2 |
| Comparative Example 3 | T-10 | Not confirmed | 10 | 150 | Observed | 9.2 |

Whether or not a triplet signal was observed around a chemical shift δ of 6.5 in the respective $^{1}$H-NMR spectra is indicated in "NMR" in Table 5. Calculation results of the toner aggregation rates are indicated in "Aggregation rate". Evaluation results as to the presence or absence of contamination by the first external additive particles are indicated in "Contamination". Calculation results of the detachment ratios of the first external additive particles are indicated in "Detachment ratio".

The toners T-1 to T-7 (toners according to Examples 1 to 7) each had positive chargeability and each included a plurality of toner particles. The toner particles each included a toner mother particle and an external additive. The toner mother particle included a toner core containing a binder resin and a shell layer covering the surface of the toner core. The external additive contained a plurality of first external additive particles each containing a resin. The first external additive particles were present on the surface of the shell layer. The toner core and each of the first external additive particles were bonded together through the specific covalent bond. When any of the toners T-1 to T-7 was used, detachment of the first external additive particles from the toner mother particles and contamination of the developing device by the first external additive particles could be inhibited without involving impairment of heat resistance and low-temperature fixability.

What is claimed is:

1. An electrostatic latent image developing toner comprising a plurality of toner particles, wherein the electrostatic latent image developing toner has positive chargeability, the toner particles each include a toner mother particle and an external additive, the toner mother particle includes a toner core containing a binder resin and a shell layer covering a surface of the toner core, the external additive contains a plurality of first external additive particles each containing a resin, the first external additive particles are present on a surface of the shell layer, the toner core and each of the first external additive particles are bonded together through a covalent bond in the shell layer, the covalent bond includes a first amide bond and a second amide bond, the shell layer contains a vinyl resin, the vinyl resin includes a constitutional unit represented by the following formula (1-1), a constitutional unit represented by the following formula (1-2), and a constitutional unit represented by the following formula (1-3), the first amide bond is an amide bond included in the constitutional unit represented by the formula (1-1), the second amide bond is an amide bond included in the constitutional unit represented by the formula (1-2):

(1-1)

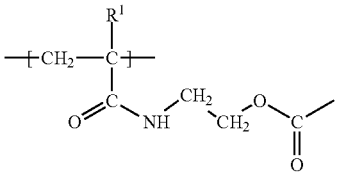

where in the formula (1-1), $R^1$ represents a hydrogen atom or an optionally substituted alkyl group, and an available bond of a carbon atom bonded to two oxygen atoms is bonded to an atom constituting the binder resin;

(1-2)

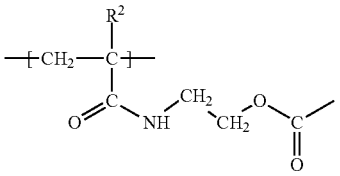

where in the formula (1-2), $R^2$ represents a hydrogen atom or an optionally substituted alkyl group, and an available bond of a carbon atom bonded to two oxygen atoms is bonded to an atom constituting the resin that the first external additive particles each contain; and (1-3)

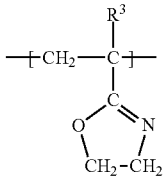

in the formula (1-3), $R^3$ represents a hydrogen atom or an optionally substituted alkyl group.

2. The electrostatic latent image developing toner according to claim 1, wherein a detachment ratio of the first external additive particles is at least 0.1% and less than 5.0% after 10-minute irradiation of the electrostatic latent image developing toner with a ultrasonic having a high frequency output of 100 W and an oscillation frequency of 50 kHz.

3. The electrostatic latent image developing toner according to claim 1, wherein the shell layer further contains a positively chargeable resin and a hydrophobic resin, the positively chargeable resin has higher positive chargeability than the binder resin, and the hydrophobic resin has higher hydrophobicity than the positively chargeable resin.

4. The electrostatic latent image developing toner according to claim 3, wherein the vinyl resin is present at a part of the shell layer that is located between the toner core and each of the first external additive particles, and the positively chargeable resin and the hydrophobic resin cover a part of a surface region of the toner core that is exposed from among the vinyl resin.

5. The electrostatic latent image developing toner according to claim 4, wherein the shell layer has an extension portion, the extension portion extends outward in a radial direction of the toner particle from a part of the shell layer that is located between the toner core and each of the first external additive particles to cover a part of a surface of at least one of the first external additive particles, and the extension portion is constituted by the vinyl resin.

6. The electrostatic latent image developing toner according to claim 3, wherein the external additive further contains a plurality of second external additive particles, the second external additive particles each are located at a part of a surface region of the shell layer that is exposed from among the first external additive particles, and the second external additive particles are constituted by silica or a metal oxide.

7. The electrostatic latent image developing toner according to claim 1, wherein the binder resin has an acid value of at least 1.0 mgKOH/g and no greater than 10.0 mgKOH/g, and the resin that the first external additive particles each contain has an acid value of at least 1.0 mgKOH/g and no greater than 50.0 mgKOH/g.

* * * * *